US009804537B2

(12) United States Patent
Mizuno et al.

(10) Patent No.: US 9,804,537 B2
(45) Date of Patent: Oct. 31, 2017

(54) IMAGE FORMING APPARATUS THAT ENSURES HIGHLY ACCURATE POSITIONING ON PHOTORECEPTOR DRUM OF PRIMARY TRANSFER ROLLER

(71) Applicant: KYOCERA Document Solutions Inc., Osaka (JP)

(72) Inventors: Masahiko Mizuno, Osaka (JP); Daisuke Fujiwara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/334,976

(22) Filed: Oct. 26, 2016

(65) Prior Publication Data

US 2017/0123351 A1 May 4, 2017

(30) Foreign Application Priority Data

Oct. 29, 2015 (JP) ..... 2015-213122

(51) Int. Cl.
*G03G 15/16* (2006.01)
*G03G 21/16* (2006.01)
*G03G 15/01* (2006.01)

(52) U.S. Cl.
CPC ..... *G03G 15/1615* (2013.01); *G03G 15/0189* (2013.01); *G03G 21/1619* (2013.01);
(Continued)

(58) Field of Classification Search
CPC ..... G03G 15/1615; G03G 15/0189; G03G 21/1619; G03G 21/1647;
(Continued)

(56) References Cited

U.S. PATENT DOCUMENTS

2003/0053819 A1* 3/2003 Nomura ..... 399/110
2004/0101328 A1 5/2004 Kimura et al. ..... 399/111
(Continued)

FOREIGN PATENT DOCUMENTS

EP 1 429 199 A2 6/2004
EP 1 762 913 A1 3/2007
(Continued)

OTHER PUBLICATIONS

Extended European search report dated Mar. 7, 2017, issued by the European Office Action in corresponding application EP 16195653.7.

*Primary Examiner* — Sophia S Chen
(74) *Attorney, Agent, or Firm* — Stein IP, LLC

(57) ABSTRACT

An image forming apparatus includes an apparatus main body, a plurality of photoreceptor drums, a plurality of developing devices, a frame, an intermediate transfer unit, a secondary transfer roller, first positioning portions, and second positioning portions. The secondary transfer roller forms a secondary transfer nip portion with the first roller where the toner images are transferred to a sheet. The first positioning portions are arranged at the intermediate transfer unit and the frame. The first positioning portions position the intermediate transfer unit in a second direction inside the apparatus main body. The second positioning portions are arranged at the intermediate transfer unit and the apparatus main body. The second positioning portions position a distal end side in the mounting direction of the intermediate transfer unit in a third direction inside the apparatus main body. The third direction intersects with the first direction and the second direction.

7 Claims, 36 Drawing Sheets

(52) U.S. Cl.
CPC ..... *G03G 21/1647* (2013.01); *G03G 2215/00012* (2013.01); *G03G 2221/1654* (2013.01)

(58) Field of Classification Search
CPC . G03G 2215/00012; G03G 2221/1654; G03G 2221/1869
See application file for complete search history.

(56) References Cited

U.S. PATENT DOCUMENTS

| | | | | |
|---|---|---|---|---|
| 2004/0131380 | A1 | 7/2004 | Kuma et al. | 399/90 |
| 2005/0281584 | A1 | 12/2005 | Kimura et al. | 399/121 |
| 2006/0008288 | A1 | 1/2006 | Kuma et al. | 399/90 |
| 2007/0036584 | A1 | 2/2007 | Kimura et al. | 399/116 |
| 2007/0059033 | A1 | 3/2007 | Kitozaki | 399/110 |
| 2007/0086807 | A1 | 4/2007 | Kuma et al. | 399/90 |
| 2007/0286649 | A1* | 12/2007 | Kawasumi | G03G 21/1633 399/296 |
| 2010/0239312 | A1 | 9/2010 | Kikuchi et al. | 399/111 |
| 2015/0253695 | A1 | 9/2015 | Nakano et al. | |
| 2016/0187840 | A1* | 6/2016 | Matsuura | G03G 21/1633 399/110 |

FOREIGN PATENT DOCUMENTS

| | | | |
|---|---|---|---|
| JP | 2004-151389 | A | 5/2004 |
| JP | 2014-123101 | A | 7/2014 |

* cited by examiner

IMAGE FORMING APPARATUS THAT ENSURES HIGHLY ACCURATE POSITIONING ON PHOTORECEPTOR DRUM OF PRIMARY TRANSFER ROLLER

INCORPORATION BY REFERENCE

This application is based upon, and claims the benefit of priority from, corresponding Japanese Patent Application No. 2015-213122 filed in the Japan Patent Office on Oct. 29, 2015, the entire contents of which are incorporated herein by reference.

BACKGROUND

Unless otherwise indicated herein, the description in this section is not prior art to the claims in this application and is not admitted to be prior art by inclusion in this section.

As a typical image forming apparatus employing an electrophotographic method such as a printer and a copier, there has been known an image forming apparatus that includes a photoreceptor drum and an intermediate transfer unit. The photoreceptor drum carries an electrostatic latent image. The intermediate transfer unit transfers a toner image from this photoreceptor drum to a sheet. The intermediate transfer unit includes an intermediate transfer belt and a primary transfer roller to transfer an image with a plurality of colors, typified by a full-color image, to the sheet. The intermediate transfer belt is opposed to and circles around a plurality of the photoreceptor drums. A primary transfer voltage is applied to the primary transfer roller to transfer the toner images from respective photoreceptor drums onto the intermediate transfer belt.

There has been disclosed a technique where respective drum units supporting intermediate transfer units and photoreceptor drums are removably attachable to an apparatus main body of an image forming apparatus.

SUMMARY

An image forming apparatus according to one aspect of the disclosure includes an apparatus main body, a plurality of photoreceptor drums, a plurality of developing devices, a frame, an intermediate transfer unit, a secondary transfer roller, first positioning portions, and second positioning portions. The plurality of photoreceptor drums are each rotatably driven around shaft centers extending in a first direction. The photoreceptor drums form electrostatic latent images on circumference surfaces. The photoreceptor drums are arranged in a second direction with intervals. The second direction is perpendicular to the first direction. The plurality of developing devices are opposed to the plurality of respective photoreceptor drums. The developing devices supply toner to the circumference surfaces on the photoreceptor drums to form toner images on the circumference surfaces. The frame supports the plurality of photoreceptor drums and the plurality of developing devices. The frame is removably attachable to the apparatus main body along the second direction. The frame is positioned to and secured to the apparatus main body. The intermediate transfer unit includes an intermediate transfer belt, a first roller, a second roller, and a plurality of primary transfer rollers. The intermediate transfer unit is mounted to the frame to be removably attachable to the apparatus main body integrated with the frame. The intermediate transfer belt runs to extend along the second direction. The intermediate transfer belt is opposed to the plurality of photoreceptor drums and circularly driven. The toner images are transferred from the plurality of photoreceptor drums to the intermediate transfer belt. The first roller supports the intermediate transfer belt at a distal end side in a mounting direction of the frame with respect to the apparatus main body. The second roller supports the intermediate transfer belt at a rear end side in the mounting direction. The plurality of primary transfer rollers are each opposed to the photoreceptor drums across the intermediate transfer belt at an inner peripheral portion of the intermediate transfer belt. The primary transfer rollers cause the toner images to be transferred from the photoreceptor drums to the intermediate transfer belt. The secondary transfer roller is arranged in the apparatus main body to be opposed to the first roller across the intermediate transfer belt. The secondary transfer roller forms a secondary transfer nip portion with the first roller where the toner images are transferred to a sheet. The first positioning portions are arranged at the intermediate transfer unit and the frame. The first positioning portions position the intermediate transfer unit in the second direction inside the apparatus main body. The second positioning portions are arranged at the intermediate transfer unit and the apparatus main body. The second positioning portions position a distal end side in the mounting direction of the intermediate transfer unit in a third direction inside the apparatus main body. The third direction intersects with the first direction and the second direction.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1A:
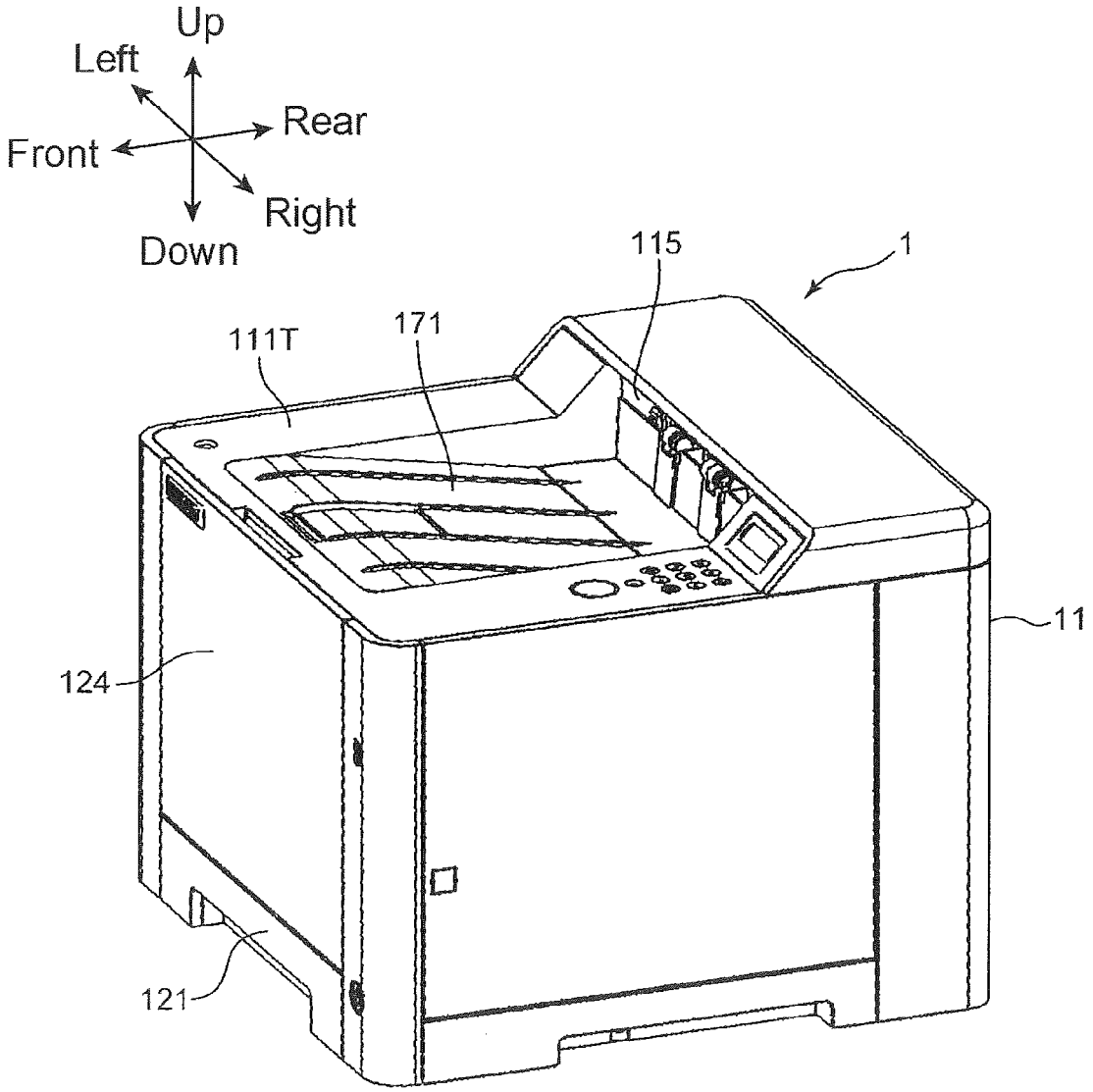
FIG. 1A obliquely illustrates an external appearance according to an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an image forming apparatus 1 according to embodiments of the disclosure in detail with reference to the accompanying drawings. This embodiment exemplifies a tandem type color printer as an exemplary image forming apparatus. The image forming apparatus may be devices such as a copier, a facsimile device, and a multi-functional peripheral of these devices.

Figure 1B:
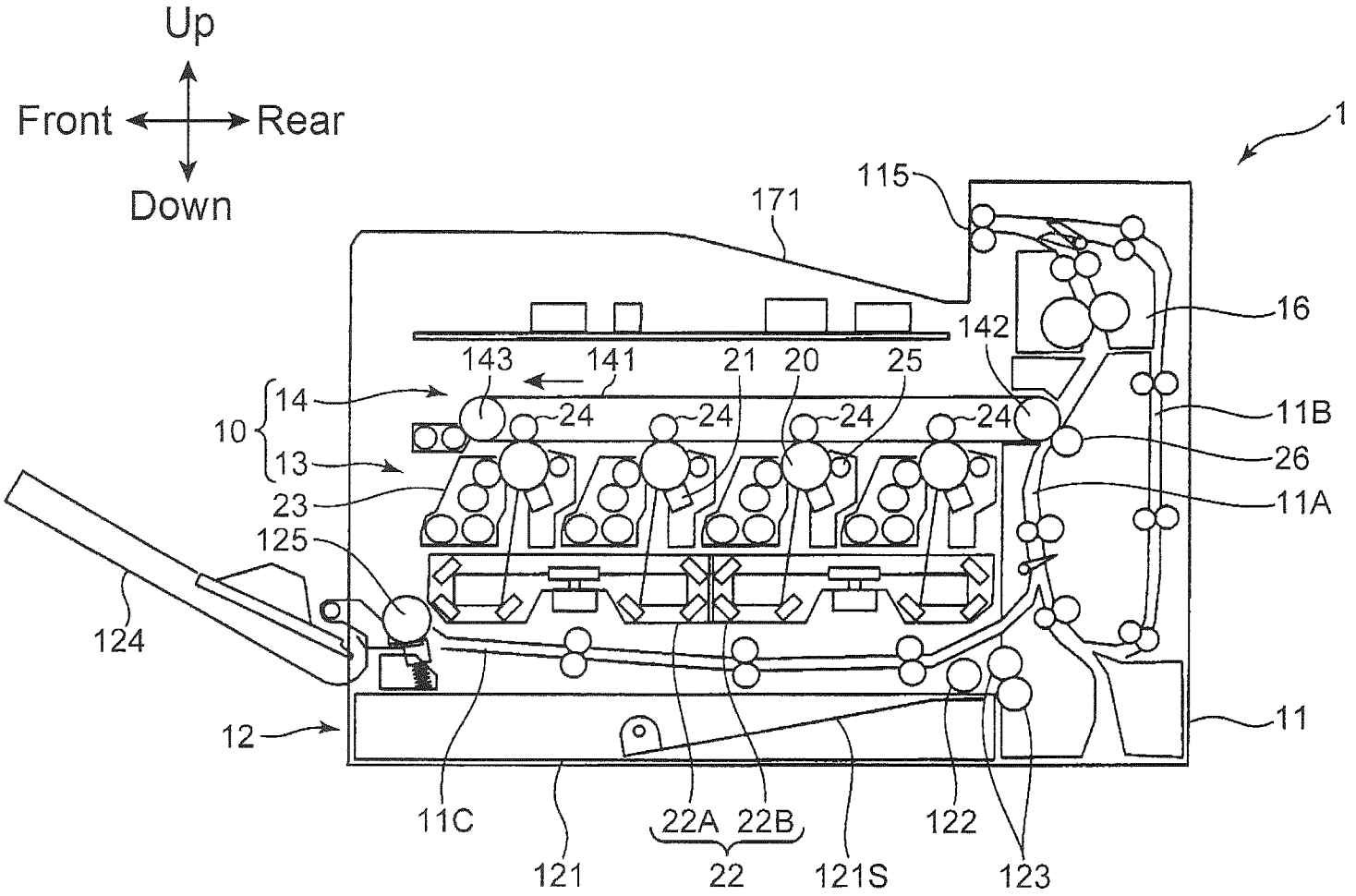
FIG. 1B illustrates a cross section of an internal structure of the image forming apparatus according to the one embodiment.

FIG. 1A obliquely illustrates an external appearance of the image forming apparatus 1 according to an embodiment of the disclosure. FIG. 1B illustrates a cross section of an internal structure of the image forming apparatus 1. This image forming apparatus 1 includes an apparatus main body 11 with a box-shaped chassis structure. This apparatus main body 11 internally includes a paper sheet feeder 12, which feeds a sheet, an image forming unit 10, which includes an imaging unit 13 and an intermediate transfer unit 14, a secondary transfer rollers 26, a toner replenishment unit (not illustrated), which replenishes the imaging unit 13 with toner, and a fixing unit 16, which fixes an unfixed toner image formed on the sheet to the sheet. Furthermore, at the upper portion of the apparatus main body 11, a sheet discharge tray 171 to which the sheet fixed by the fixing unit 16 is discharged is provided.

At an appropriate position on the top surface of the apparatus main body 11, an operation panel (not illustrated) for an input operation of an output condition or a similar condition to the sheet is located. This operation panel includes a power key, a touch panel to input the output condition, and various operation keys. Additionally, the apparatus main body 11 internally includes a sheet conveyance path 11A, which extends in a vertical direction, at a position right side of the imaging unit 13. The sheet conveyance path 11A includes a conveyance roller pair to feed the sheet to an appropriate position. A registration roller pair is located upstream with respect to a secondary transfer nip portion, which will be described later, in the sheet conveyance path 11A. The registration roller pair performs skew correction on the sheet and sends out the sheet to the nip portion at a predetermined timing. The sheet conveyance path 11A is a conveyance path that feeds the sheet from the paper sheet feeder 12 to the sheet discharge tray 171 via the imaging unit 13 (the secondary transfer nip portion) and the fixing unit 16.

The paper sheet feeder 12 includes a sheet feed cassette 121, a pickup roller 122, and a feed roller pair 123. The sheet feed cassette 121 is insertably/removably mounted to a lower position of the apparatus main body 11 to accumulate a sheet bundle, which is a plurality of stacked sheets. The sheet feed cassette 121 includes a lift plate 121S.

The pickup roller 122 feeds out the sheet on the uppermost surface of the sheet bundle accumulated at the sheet feed cassette 121 one by one. The feed roller pair 123 sends out the sheet fed out by the pickup roller 122 to the sheet conveyance path 11A. The paper sheet feeder 12 further includes a bypass tray 124 and a pickup roller 125. The bypass tray 124 is a tray on which the sheet is manually placed. When the sheet is manually fed, as illustrated in FIG.

1B, the bypass tray 124 is opened from the front surface of the apparatus main body 11. The pickup roller 125 feeds out the sheet placed on the bypass tray 124. A manual conveyance path 11C runs rearward from the bypass tray 124. The sheet is carried in the sheet conveyance path 11A via the manual conveyance path 11C.

The image forming unit 10 includes the imaging unit 13 and the intermediate transfer unit 14. The imaging unit 13 is arranged at the lower part of the image forming unit 10 while the intermediate transfer unit 14 is arranged at the upper part of the image forming unit 10.

The imaging unit 13 forms a toner image to be transferred to the sheet. The imaging unit 13 includes a plurality of units, which form toner images of different colors. As the units, this embodiment includes a magenta unit, which uses a magenta (M) color developer, a cyan unit, which uses a cyan (C) color developer, a yellow unit, which uses a yellow (Y) color developer, and a black unit, which uses a black (Bk) color developer, sequentially from upstream to downstream in a rotation direction of an intermediate transfer belt 141 (from the front to the rear shown in FIG. 1B). The units each include a photoreceptor drum 20 (an image carrier), a charging apparatus 21, which is arranged at a peripheral area of the photoreceptor drum 20, a developing device 23, and a cleaning apparatus 25. An exposure apparatus 22 shared by the respective units is arranged below the image forming unit. The exposure apparatus 22 includes a first exposure apparatus 22A and a second exposure apparatus 22B.

The photoreceptor drum 20 is rotatably driven around the axis, and an electrostatic latent image and a toner image are formed on a circumference surface of the photoreceptor drum 20. A rotation shaft of the photoreceptor drum 20 extends in a first direction (a lateral direction) perpendicular to the rotation direction of the intermediate transfer belt 141. As this photoreceptor drum 20, a photoreceptor drum using an amorphous silicon (a—Si)-based material is applicable. As illustrated in FIG. 1B, the plurality of photoreceptor drums 20 corresponding to the respective colors are arranged in a second direction (the front-rear direction, a horizontal direction) perpendicular to the first direction with predetermined intervals.

The charging apparatus 21 uniformly charges the surface of the photoreceptor drum 20. As the charging apparatus 21, a charging apparatus with a contact electrification method can be employed. The charging apparatus 21 includes a charging roller and a charging cleaning brush to remove toner attached to the charging roller. The exposure apparatus 22 includes various optical system devices such as a light source, a polygon mirror, a reflection mirror, and a deflecting mirror. The exposure apparatus 22 irradiates the uniformly charged circumference surface of the photoreceptor drum 20 with light modulated based on image data to form the electrostatic latent image. The cleaning apparatus 25 cleans the circumference surface of the photoreceptor drum 20 after toner image transfer.

The developing device 23 supplies the circumference surface of the photoreceptor drum 20 with toner to develop the electrostatic latent image formed on the photoreceptor drum 20. The developing device 23 is for two-component developer constituted of toner and a carrier. The developing device 23 supplies the toner to the circumference surface of the photoreceptor drum 20 to develop the electrostatic latent image. In this embodiment, the toner has a property that charges to a positive polarity. As illustrated in FIG. 1B, the plurality of developing devices 23 corresponding to the respective colors are each arranged opposed to the photoreceptor drums 20.

The intermediate transfer unit 14 is located at a space arranged above the plurality of imaging units 13. The intermediate transfer unit 14 includes the intermediate transfer belt 141, a drive roller 142, a tension roller 143, and a plurality of primary transfer rollers 24.

The intermediate transfer belt 141 is an endless belt-shaped rotator and is suspended across the drive roller 142 and the tension roller 143 such that its circumference surface side is opposed to the respective circumference surfaces of the photoreceptor drums 20. The intermediate transfer belt 141 is circularly driven along the front-rear direction and carries the toner image transferred from the plurality of photoreceptor drums 20 on its surface. The intermediate transfer belt 141 is a conductive soft belt with a laminated structure formed of a base layer, an elastic layer, and a coat layer.

The drive roller 142 stretches the intermediate transfer belt 141 at a right end side of the intermediate transfer unit 14, and causes the intermediate transfer belt 141 to circularly drive. The drive roller 142 is constituted of a metal roller. The tension roller 143 stretches the intermediate transfer belt 141 at the left end side of the intermediate transfer unit 14. The tension roller 143 provides the intermediate transfer belt 141 with a tensile strength.

The plurality of primary transfer rollers 24 are each located opposed to the photoreceptor drums 20 across the intermediate transfer belt 141 at the inner peripheral portion of the intermediate transfer belt 141. This forms primary transfer nip portions between the primary transfer rollers 24 and the photoreceptor drums 20. The primary transfer rollers 24 cause the toner images to be primarily transferred from the photoreceptor drums 20 to the intermediate transfer belt 141. As illustrated in FIG. 1B, the respective primary transfer rollers 24 are opposed to the photoreceptor drums 20 for the respective colors. The primary transfer roller 24 is a roller extending in the front-rear direction and rotationally driven together with the intermediate transfer belt 141.

The secondary transfer roller 26 is opposed to the drive roller 142 across the intermediate transfer belt 141. The secondary transfer roller 26 is pressed to the circumference surface of the intermediate transfer belt 141 to form the secondary transfer nip portion with the drive roller 142. The toner image primarily transferred on the intermediate transfer belt 141 is secondarily transferred on the sheet supplied from the paper sheet feeder 12 at the secondary transfer nip portion. As described later, the secondary transfer roller 26 is rotatably supported at the inside of the apparatus main body 11.

The fixing unit 16 includes a heating roller, which internally includes a heat source, and a pressure roller, which is opposed to the fixing roller and forms a fixing nip portion. The sheet supplied to the fixing unit 16 passes through the fixing nip portion to be heated and pressurized. This fixies the toner image, which has been transferred to the sheet at the secondary transfer nip portion, to the sheet.

The sheet discharge tray 171 is formed by depressing a top surface portion 111T (see FIG. 1A) of the apparatus main body 11. The sheet on which the fixing process has been performed is discharged from a discharge port 115 to the sheet discharge tray 171 via the sheet conveyance path 11A, which runs up to the upper portion of the fixing unit 16. When images are formed on both surfaces of a sheet, the sheet where the image has been formed on one surface is again carried in the sheet conveyance path 11A via a duplex conveyance path 11B.

Figure 2A:
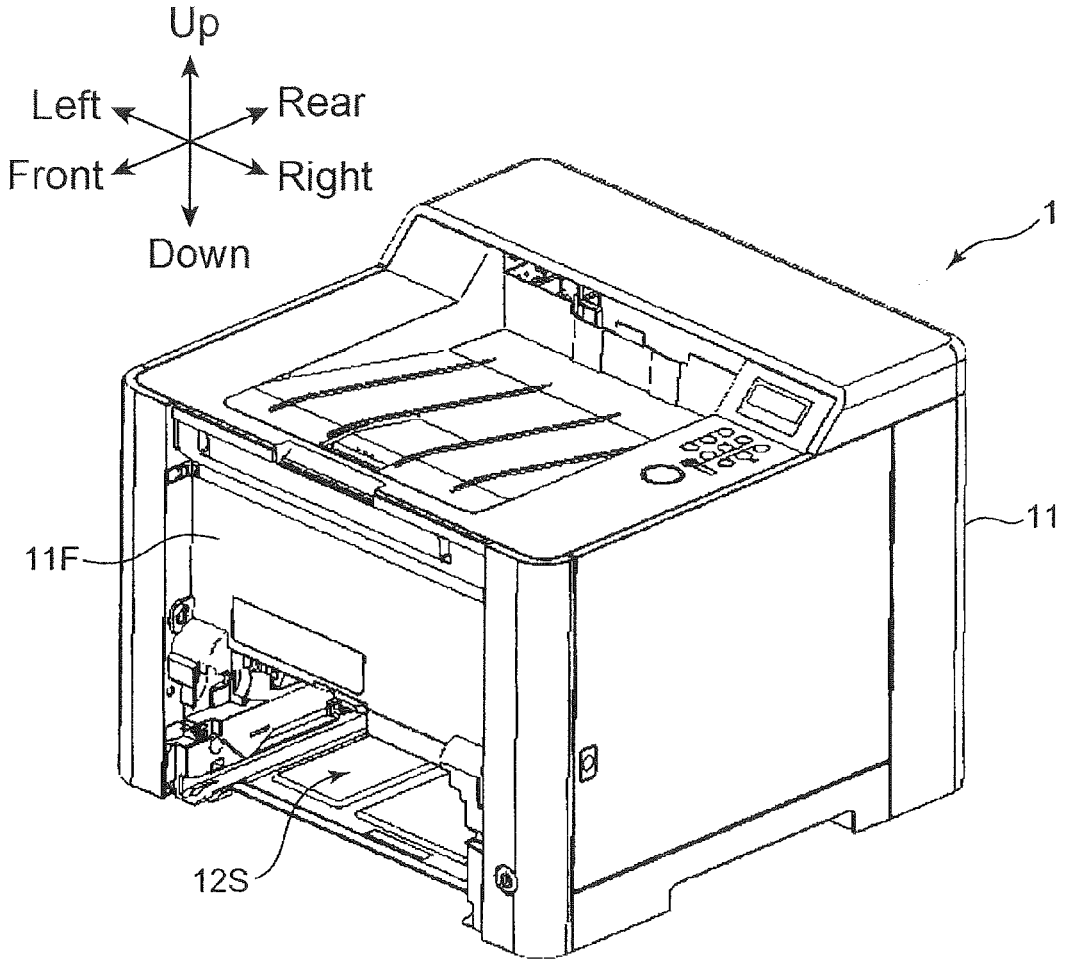
FIG. 2A obliquely illustrates the image forming apparatus according to the one embodiment from which a sheet feed tray and a bypass tray are removed.
Figure 2B:
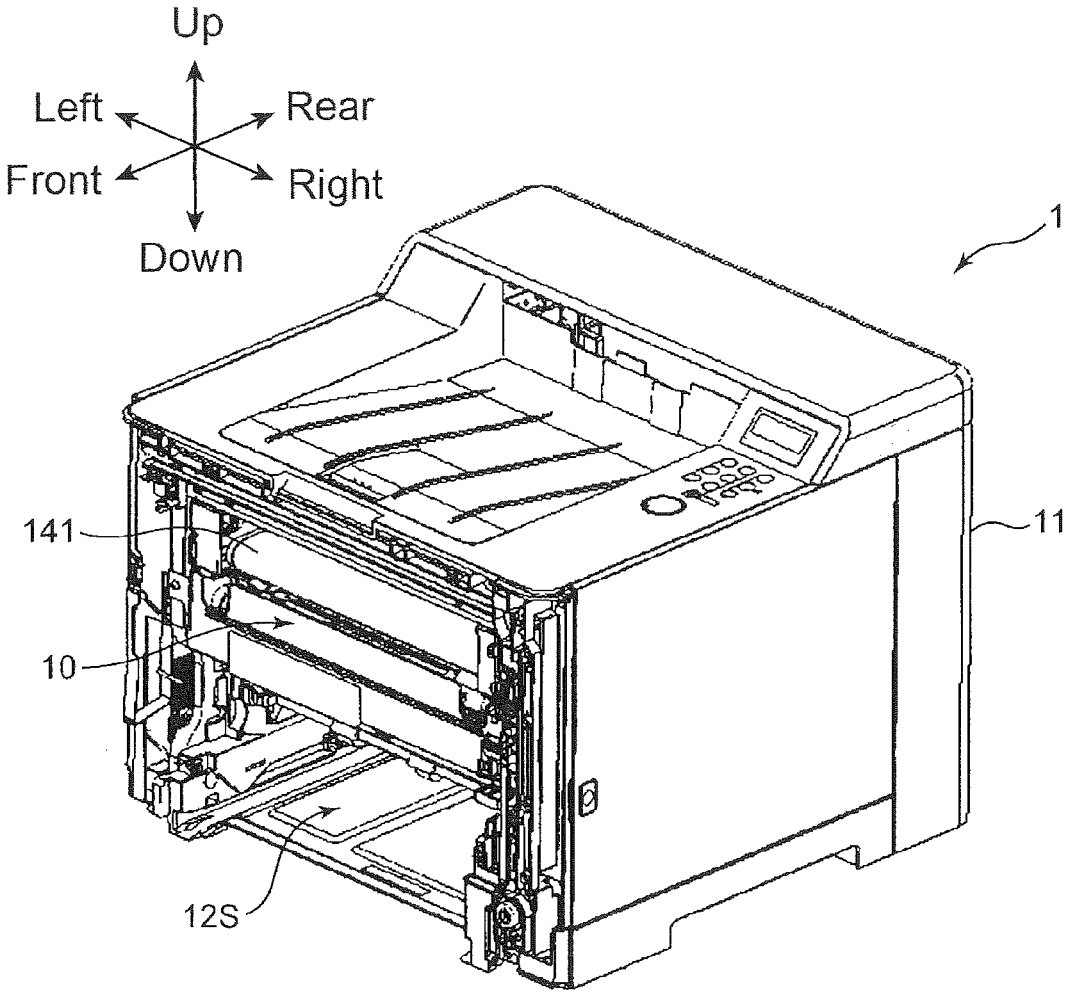
FIG. 2B obliquely illustrates the image forming apparatus according to the one embodiment from which an inner cover is further removed.
Figure 2C:
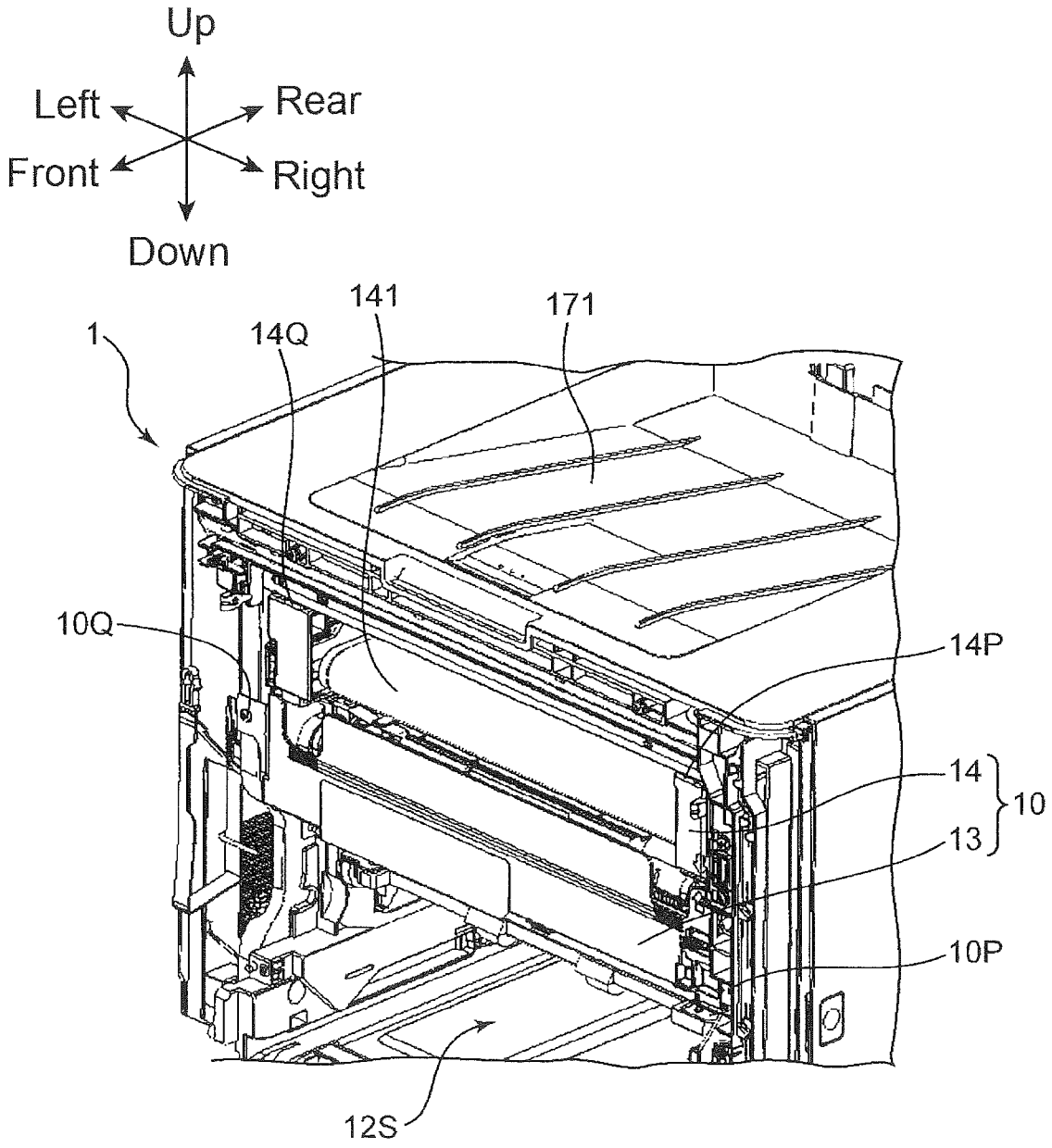
FIG. 2C obliquely illustrates a partially enlarged image forming apparatus according to the one embodiment.
Figure 3A:
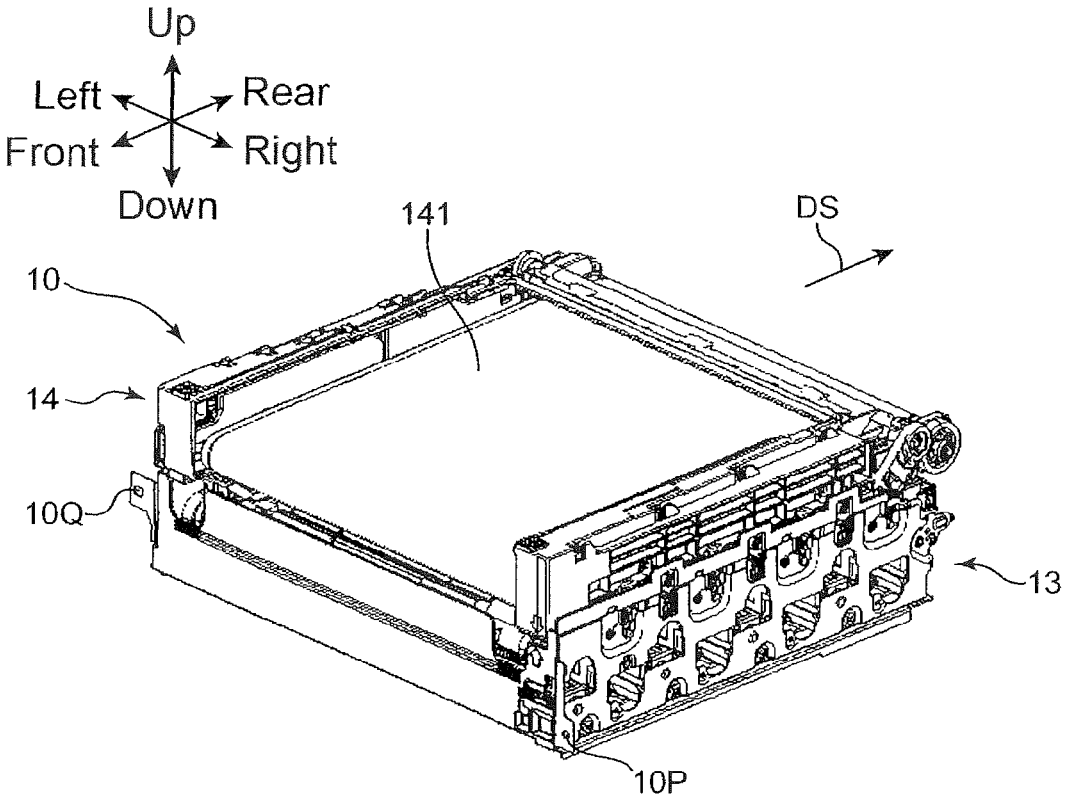
FIG. 3A obliquely illustrates the image forming unit according to the one embodiment.
Figure 3B:
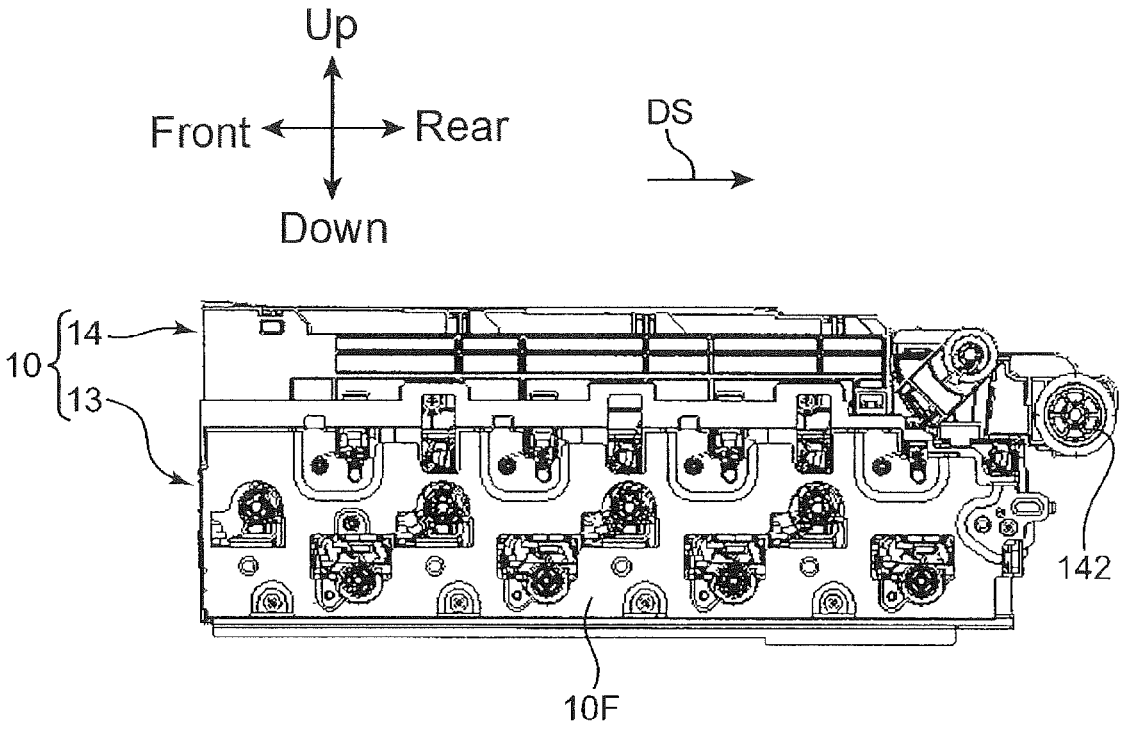
FIG. 3B illustrates a side surface of the image forming unit according to the one embodiment.

FIG. 2A obliquely illustrates the image forming apparatus 1 according to the embodiment from which the sheet feed tray 121 and the bypass tray 124 are removed. FIG. 2B obliquely illustrates the image forming apparatus 1 illustrated in FIG. 2A from which an inner cover 11F (see FIG. 2A) is further removed. FIG. 2C obliquely illustrates the partially enlarged image forming apparatus 1 illustrated in FIG. 2B. FIG. 3A obliquely illustrates the image forming unit according to the embodiment. FIG. 3B illustrates a side surface of the image forming unit. Further, FIG. 4 obliquely illustrates a state where the image forming unit 10 is mounted to the apparatus main body 11 of the image forming apparatus 1. A partial illustration in the subsequent drawings including FIG. 2C indicates a break line by wavy line.

With reference to FIGS. 1A and 2A, the image forming unit 10 includes the inner cover 11F arranged inside the bypass tray 124. When that bypass tray 124 is opened with respect to the apparatus main body 11, the inner cover 11F covers the inside of the apparatus main body 11. The inner cover 11F is arranged above a tray mounting portion 12S to which the sheet feed tray 121 is mounted at the inside of the apparatus main body 11. As illustrated in FIG. 2B, removing the inner cover 11F from the apparatus main body 11 exposes the image forming unit 10. In FIGS. 2B and 2C, the intermediate transfer belt 141 included in the intermediate transfer unit 14 of the image forming unit 10 appears.

Figure 4:
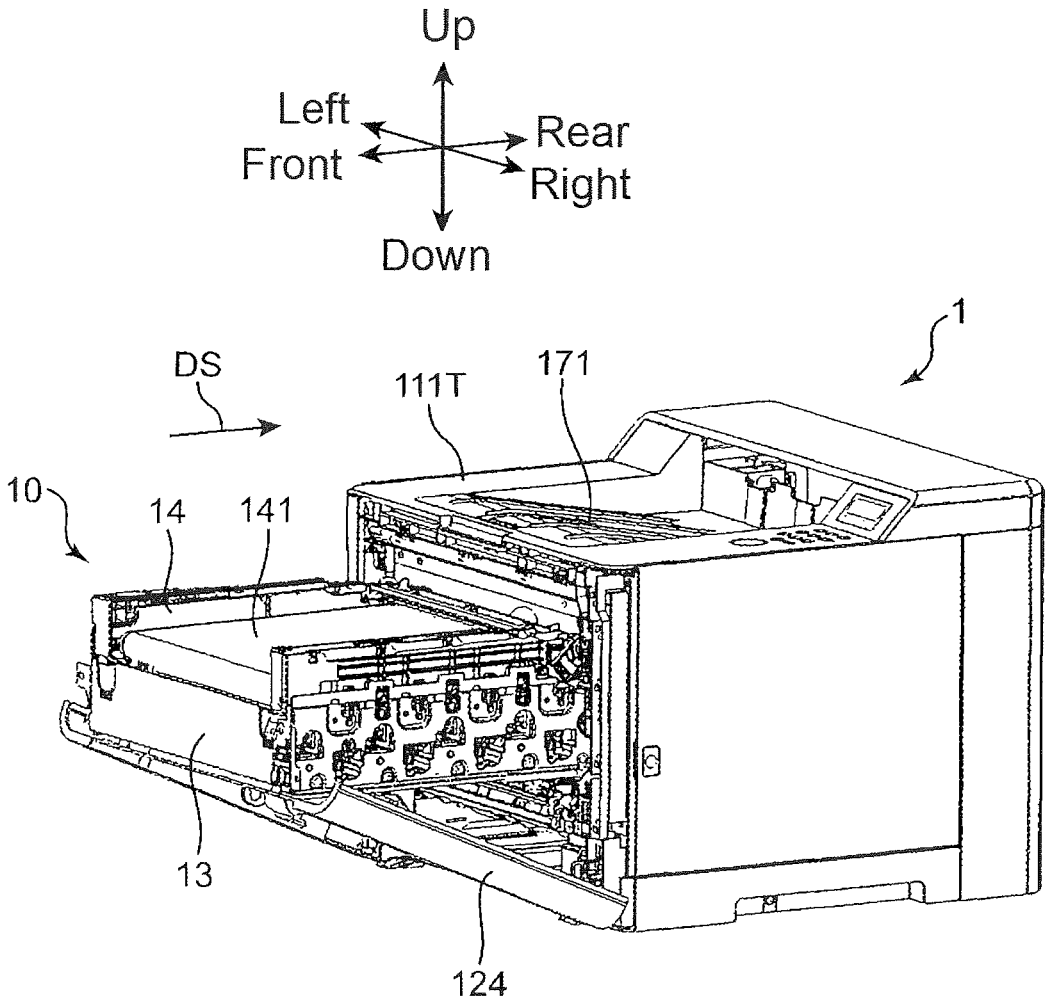
FIG. 4 obliquely illustrates a state where the image forming unit is mounted to the image forming apparatus according to the one embodiment.

As illustrated in FIG. 4, the image forming unit 10 including the imaging unit 13 and the intermediate transfer unit 14 is attached to/removed from the apparatus main body 11. FIGS. 3A to 4 indicate a mounting direction of the image forming unit 10 to the apparatus main body 11 by an arrow DS. The above-described intermediate transfer belt 141 runs so as to extend in the mounting direction (the front-rear direction) of the image forming unit 10. The drive roller 142 (the first roller) supports the intermediate transfer belt 141 at a distal end side in the mounting direction of the image forming unit 10 (an imaging frame 10F, which will be described later). The tension roller 143 (the second roller) supports the intermediate transfer belt 141 at a rear end side in the mounting direction of the image forming unit 10.

Figure 5A:
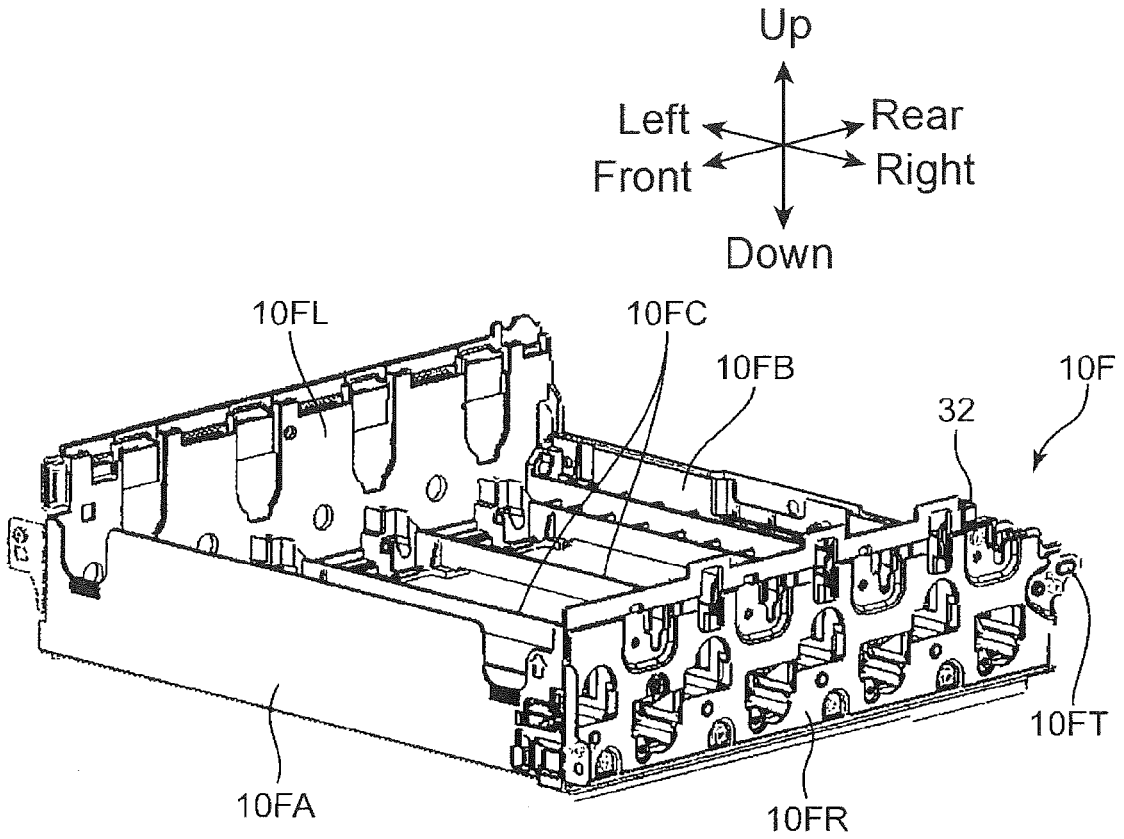
FIG. 5A obliquely illustrates a frame according to the one embodiment.
Figure 5B:
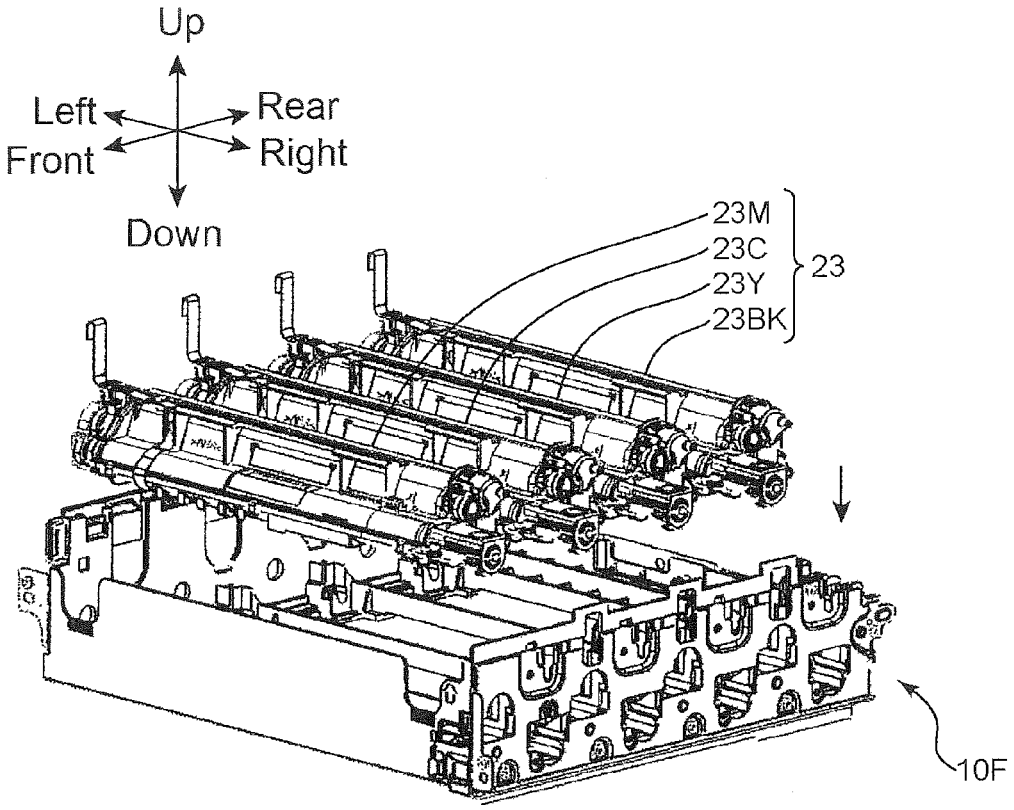
FIG. 5B obliquely illustrates a state where a plurality of developing devices are mounted to the frame according to the one embodiment.
Figure 5C:
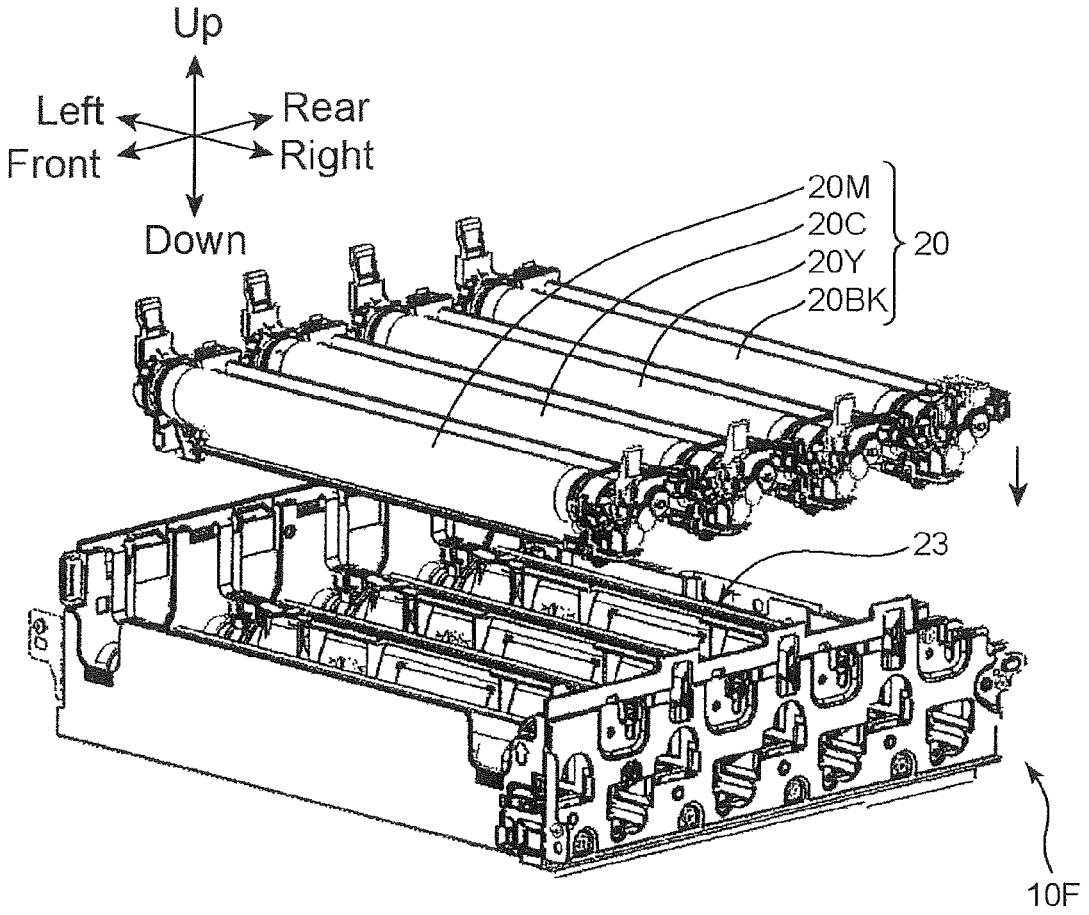
FIG. 5C obliquely illustrates a state where a plurality of photoreceptor drums are mounted to the frame according to the one embodiment.
Figure 5D:
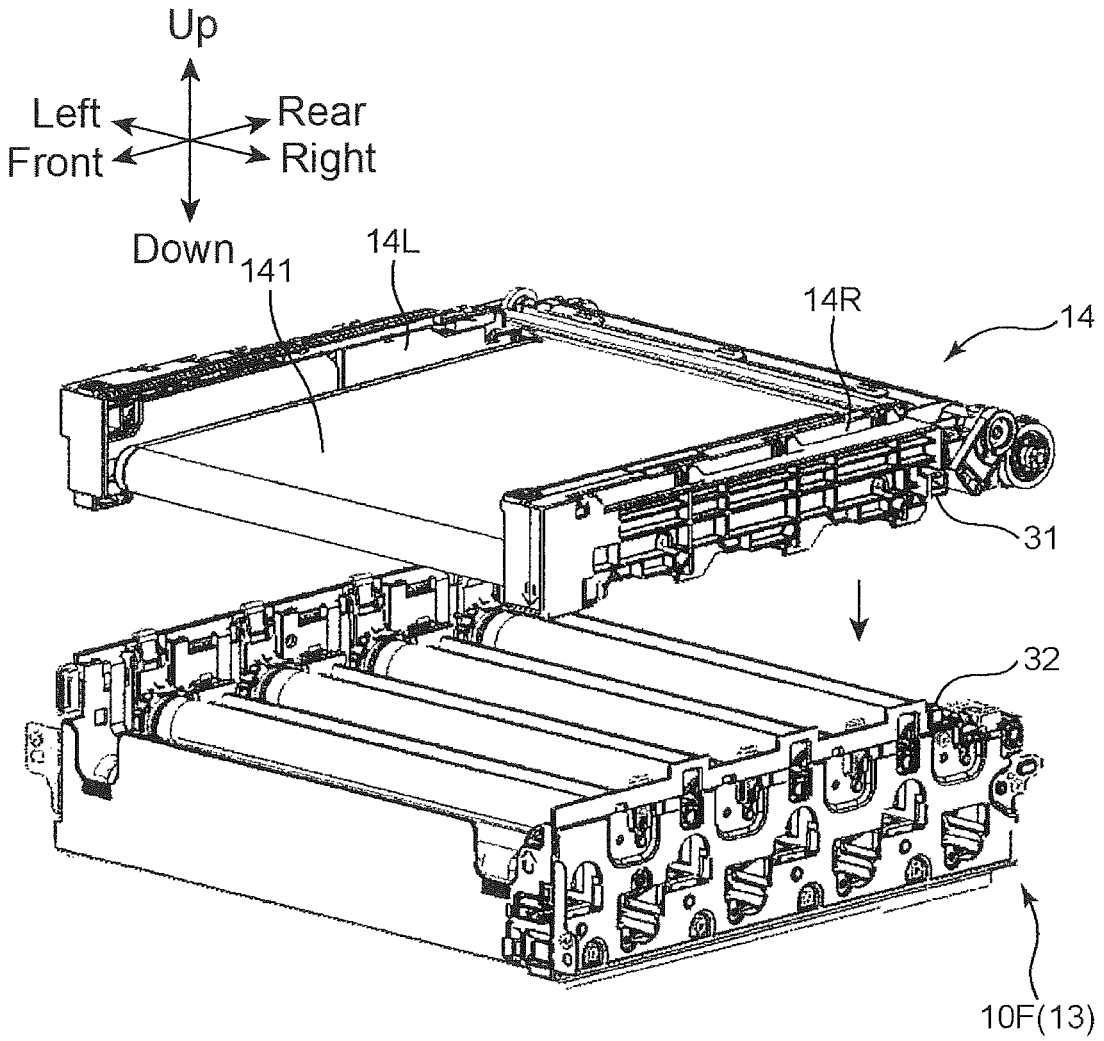
FIG. 5D obliquely illustrates a state where an intermediate transfer unit is mounted to the frame according to the one embodiment.
Figure 5E:
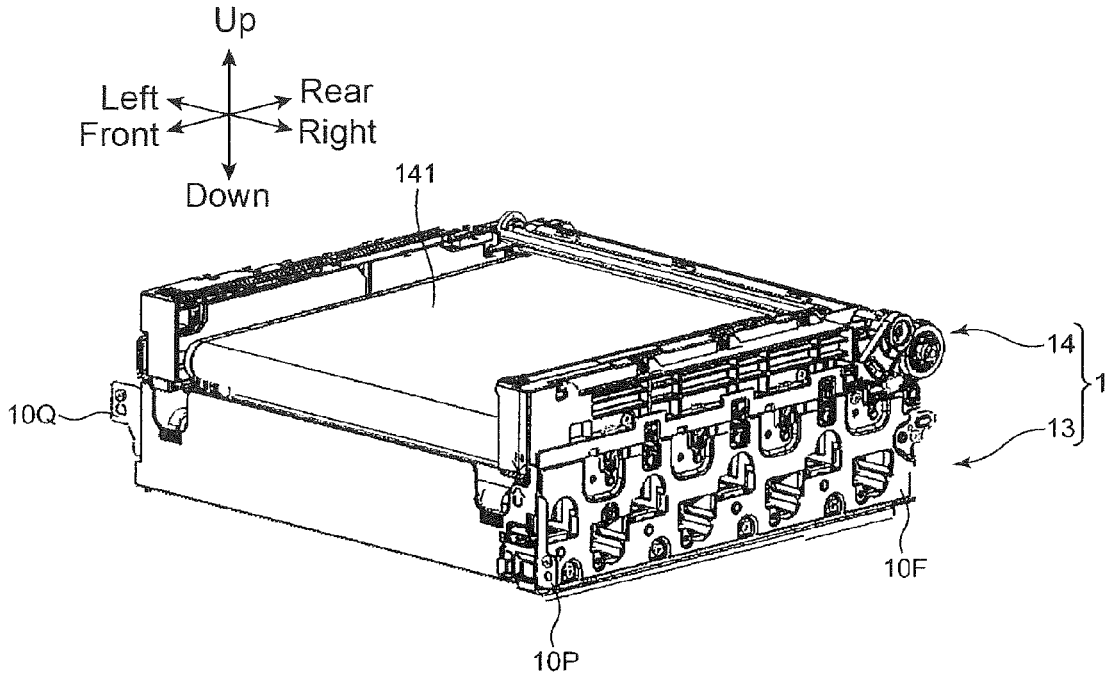
FIG. 5E obliquely illustrates the image forming unit where the plurality of photoreceptor drums and developing devices and the intermediate transfer unit are mounted to the frame according to the one embodiment.

The following describes a structure of the image forming unit 10 with reference to FIGS. 5A to 5E. The image forming unit 10 includes the imaging frame 10F (the frame). The imaging frame 10F is a metal frame supporting the plurality of photoreceptor drums 20, the developing devices 23, and the intermediate transfer unit 14. FIG. 5A obliquely illustrates the imaging frame 10F according to the embodiment. FIG. 5B obliquely illustrates a state where the plurality of developing devices 23 are mounted to the imaging frame 10F according to the embodiment. FIG. 5C obliquely illustrates a state where the plurality of photoreceptor drums 20 are mounted to the imaging frame 10F. FIG. 5D obliquely illustrates a state where the intermediate transfer unit 14 is mounted to the imaging frame 10F. FIG. 5E obliquely illustrates the image forming unit where the plurality of photoreceptor drums 20 and developing devices 23 and the intermediate transfer unit 14 are mounted to the imaging frame 10F.

With reference to FIG. 5A, the imaging frame 10F extends to the front, rear, right, and left directions with a predetermined height in the vertical direction. The imaging frame 10F includes a frame right wall 10FR, a frame left wall 10FL, a frame front wall 10FA, a frame rear wall 10FB, and frame ribs 10FC. The respective frame right wall 10FR and frame left wall 10FL are sidewalls located upright from ends of the imaging frame 10F in the lateral direction. The frame front wall 10FA and the frame rear wall 10FB define the front surface portion and the rear surface portion of the imaging frame 10F, respectively. The frame front wall 10FA and the frame rear wall 10FB connect the frame right wall 10FR with the frame left wall 10FL. The frame ribs 10FC are plurality of connecting members that connect the frame right wall 10FR and the frame left wall 10FL between the frame front wall 10FA and the frame rear wall 10FB. As illustrated in FIG. 5A, the imaging frame 10F has an opening, which is open at the top surface portion. The imaging frame 10F internally forms a space to which the respective units are mounted.

To mount the image forming unit 10 to the apparatus main body 11, the plurality of photoreceptor drums 20, the developing devices 23, and the intermediate transfer unit 14 are preliminarily mounted to the imaging frame 10F. First, as illustrated in FIG. 5B, the plurality of developing devices 23 are mounted to the inside of the imaging frame 10F from above the imaging frame 10F via the opening. Consequently, developing rollers (not illustrated) of the developing devices 23 are positioned with respect to the imaging frame 10F. The developing roller supplies the photoreceptor drum 20 with toner.

Further, as illustrated in FIG. 5C, a plurality of drum units each include the photoreceptor drums 20 are mounted to the inside of the imaging frame 10F from above the imaging frame 10F via the opening. Consequently, shaft centers of the plurality of photoreceptor drums 20 are positioned with respect to the imaging frame 10F. This decides an interval between the photoreceptor drums 20 for the respective colors and the developing rollers of the developing devices 23.

After that, as illustrated in FIG. 5D, the intermediate transfer unit 14 is mounted to the imaging frame 10F so as to cover the top surface portion (the opening) of the imaging frame 10F. The intermediate transfer unit 14 includes a unit left wall 14L and a unit right wall 14R. The unit left wall 14L and the unit right wall 14R are sidewalls extending long in the front-rear direction at ends of the intermediate transfer unit 14 in the lateral direction. The unit left wall 14L and the unit right wall 14R are made of a resin material. The above-described drive roller 142, tension roller 143, and primary transfer roller 24 are rotatably supported to the unit left wall 14L and the unit right wall 14R. As illustrated in FIG. 5E, mounting the intermediate transfer unit 14 to the imaging frame 10F configures the image forming unit 10 integrated with the plurality of photoreceptor drums 20, the developing devices 23, and the intermediate transfer unit 14. Thus, the plurality of photoreceptor drums 20, the plurality of developing devices 23, and the intermediate transfer unit 14 can be easily mounted to the imaging frame 10F along the identical mounting direction.

In this embodiment, the imaging frame 10F supports the plurality of photoreceptor drums 20 and the plurality of developing devices 23 such that the plurality of photoreceptor drums 20 and the plurality of developing devices 23 are removably attachable to the apparatus main body 11 along the front-rear direction. The intermediate transfer unit 14 is attached to and removed from the apparatus main body 11 integrally with the imaging frame 10F. This easily achieves the attachment and the removal of the intermediate transfer unit 14 to the apparatus main body 11.

The imaging frame 10F is positioned and secured at the inside of the apparatus main body 11. In detail, a pair of frame securing portions 10FT (see FIG. 5A), which are provided at distal end portions of the frame right wall 10FR and the frame left wall 10FL in the mounting direction, are inserted into insertion holes (not illustrated) inside the apparatus main body 11. In FIG. 5A, although only the frame securing portion 10FT on the frame right wall 10FR side appears, the similar securing portion is provided also at the distal end portion of the frame left wall 10FL. The pair of frame securing portions 10FT secure the vertical and lateral positions of the imaging frame 10F inside the apparatus main body 11. Further, with reference to FIG. 5E, the imaging frame 10F includes a right fastening portion 10P and a left fastening portion 10Q. The right fastening portion 10P and the left fastening portion 10Q each include screw holes. As illustrated in FIG. 2C, mounting the image forming unit 10 to the apparatus main body 11 arranges the respective right fastening portion 10P and left fastening portion 10Q opposed to a frame (not illustrated) inside the apparatus main body 11. Fastening the imaging frame 10F to the apparatus main body 11 at the right fastening portion 10P and the left fastening portion 10Q with screws secures the position of the imaging frame 10F in the front-rear direction. This decides the positions of the plurality of photoreceptor drums 20 and the plurality of developing devices 23 inside the apparatus main body 11.

The following describes the positioning of the intermediate transfer unit 14, which is mounted to the inside of the apparatus main body 11 together with the imaging frame 10F.

First Positioning Portions

Figure 6A:
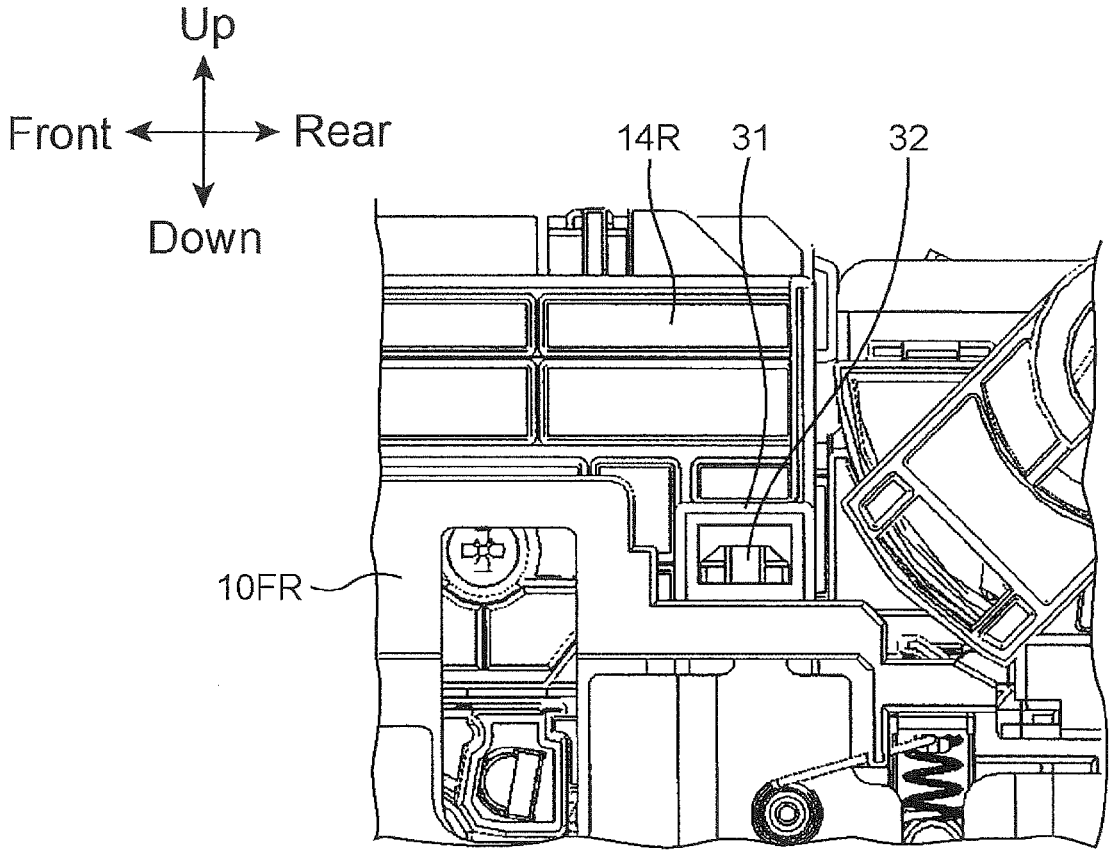
FIG. 6A illustrates one of side surfaces of first positioning portions of the image forming apparatus according to the one embodiment.
Figure 6B:
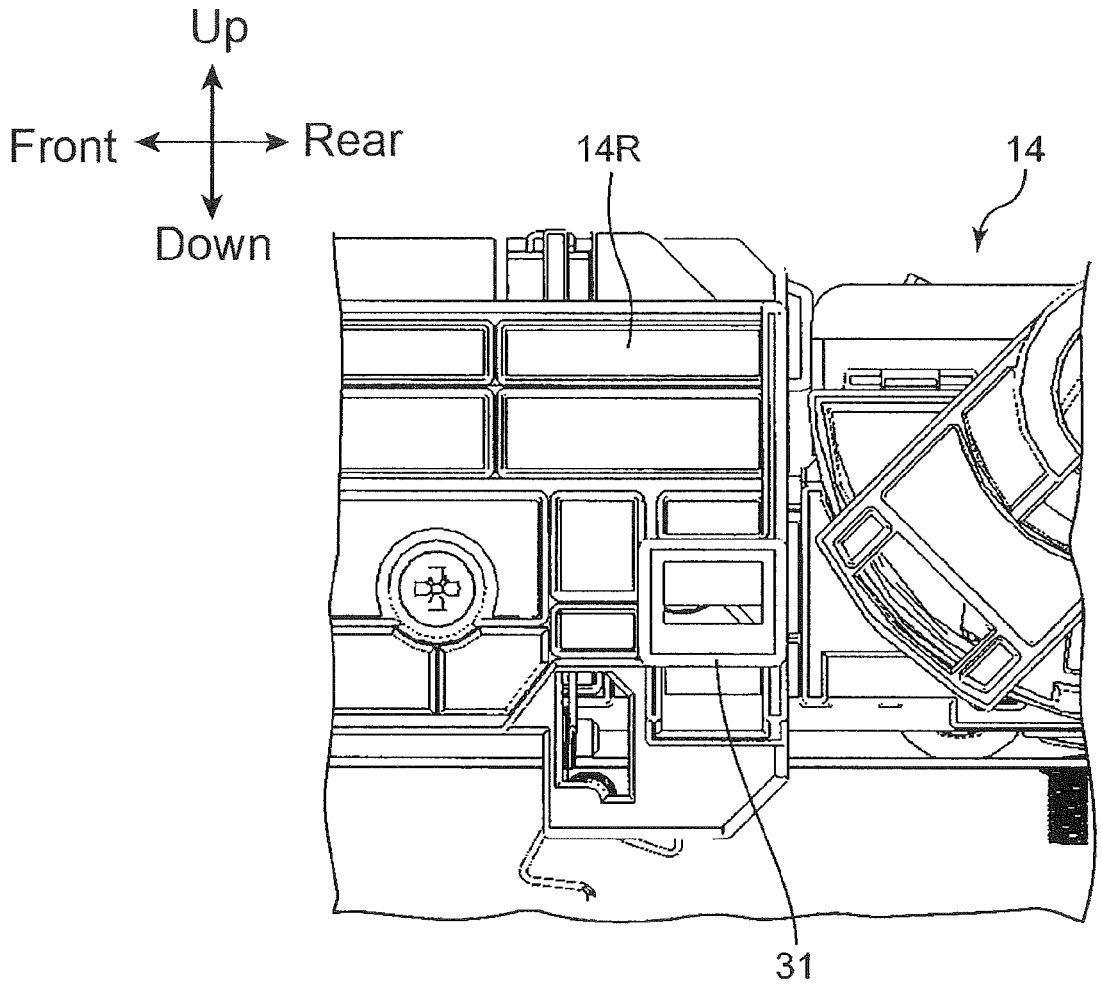
FIG. 6B illustrates a part of the side surface of the first positioning portion according to the one embodiment.
Figure 6C:
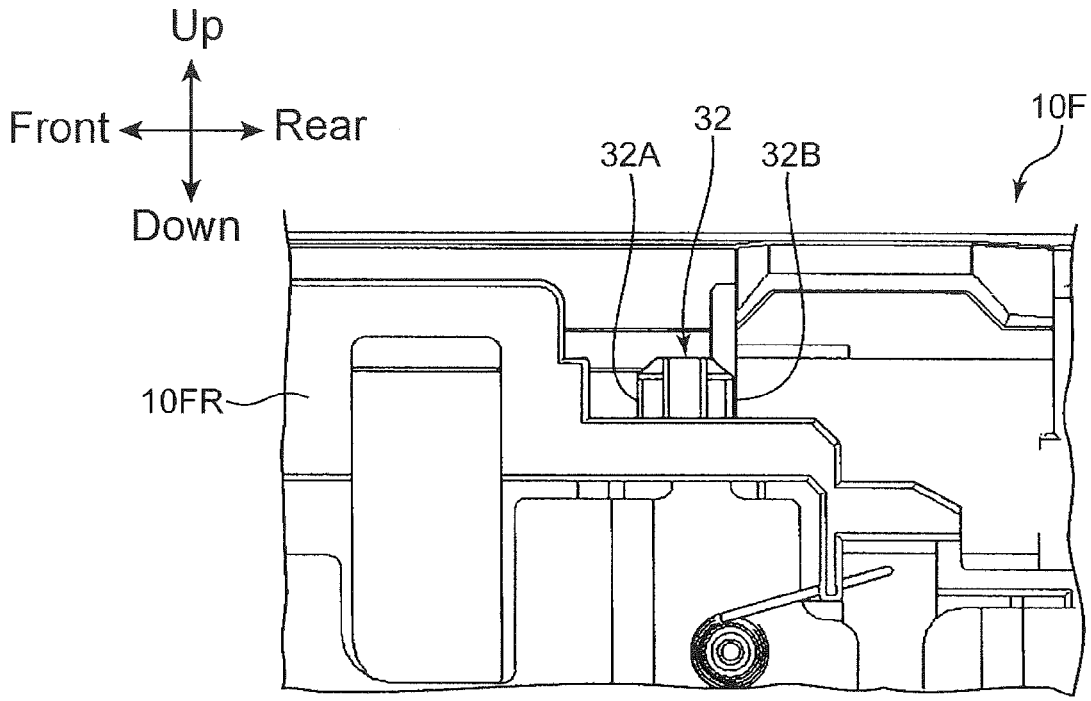
FIG. 6C illustrates a part of the side surface of the first positioning portion according to the one embodiment.
Figure 6D:
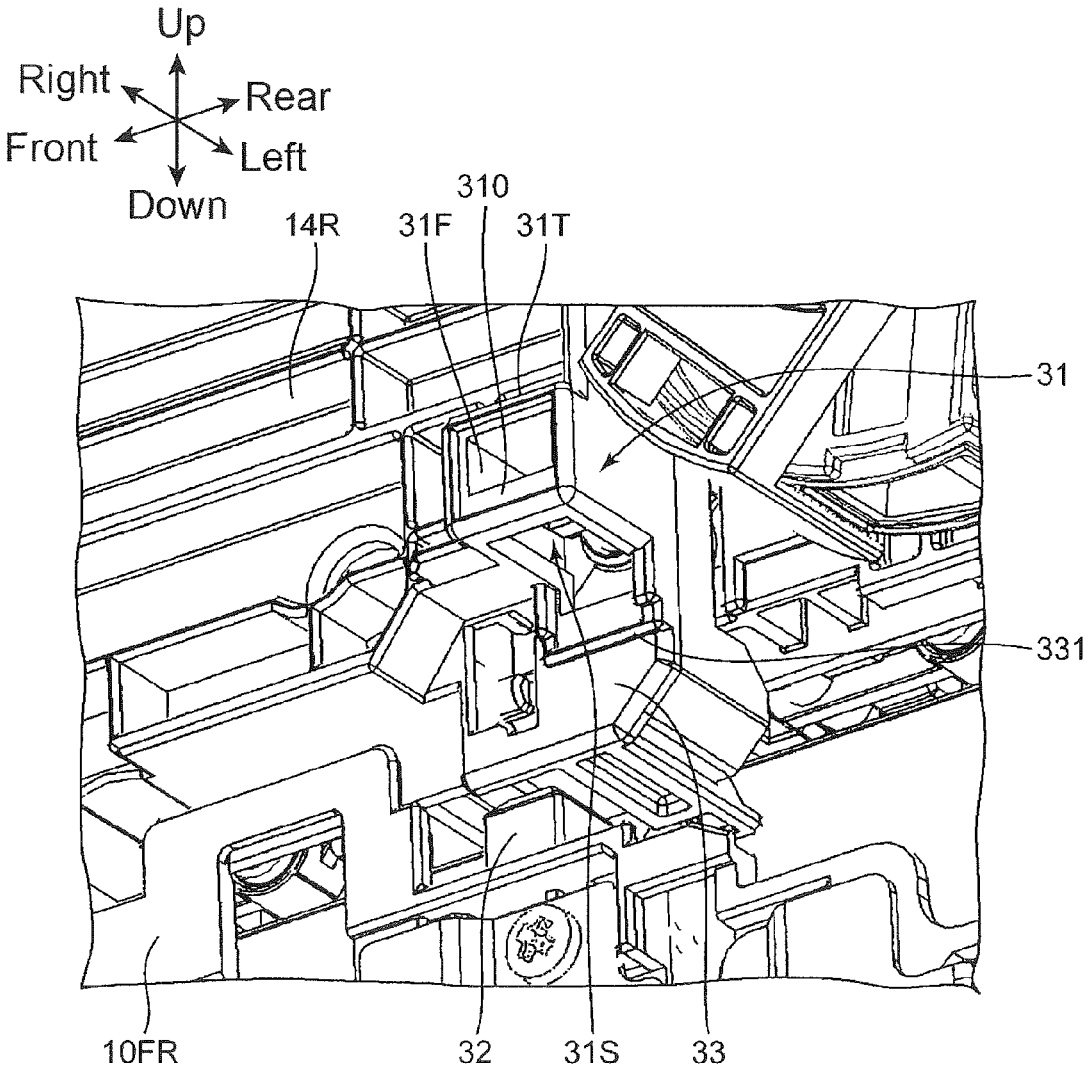
FIG. 6D obliquely illustrates the first positioning portions according to the one embodiment.
Figure 6E:
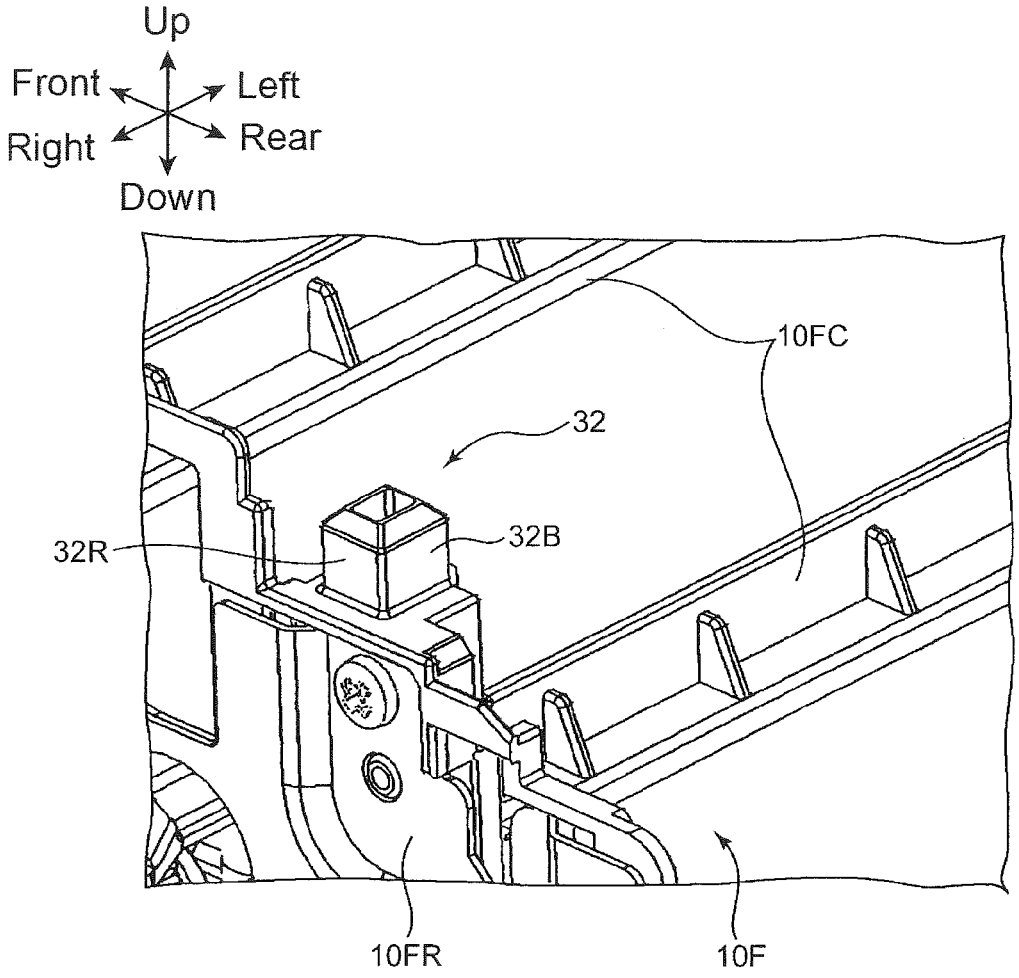
FIG. 6E obliquely illustrates a part of the first positioning portion according to the one embodiment.
Figure 6F:
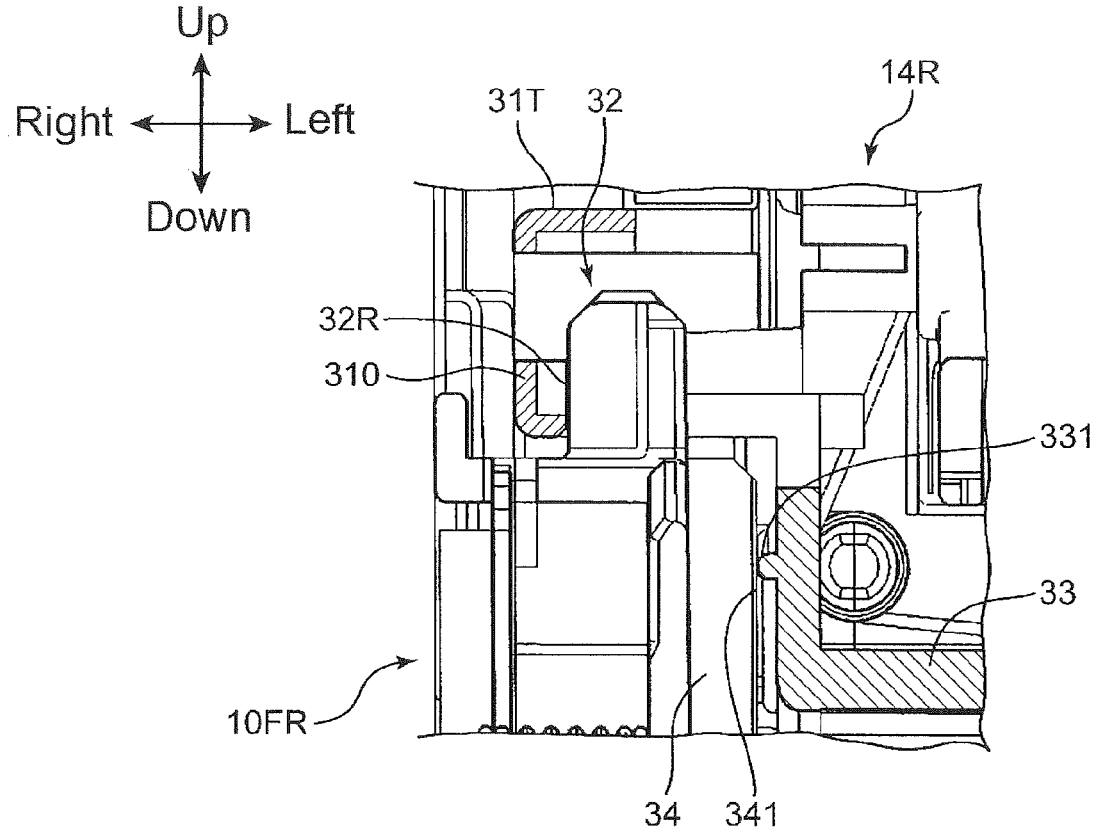
FIG. 6F illustrates a part of rear surfaces of the first positioning portions according to the one embodiment.

The image forming unit 10 includes the first positioning portions. The first positioning portions are arranged at the intermediate transfer unit 14 and the imaging frame 10F to position the intermediate transfer unit 14 in the front-rear direction (the second direction) inside the apparatus main body 11. FIG. 6A illustrates a part of side surfaces of the first positioning portions of the image forming apparatus 1 according to the embodiment. FIGS. 6B and 6C illustrate a part of the side surface of the first positioning portion illustrated in FIG. 6A. FIG. 6D obliquely illustrates the first positioning portions illustrated in FIG. 6A. FIG. 6E obliquely illustrates a part of the first positioning portion illustrated in FIG. 6A. FIG. 6F illustrates a part of rear surfaces of the first positioning portions illustrated in FIG. 6A.

With reference to FIGS. 6A to 6F, the intermediate transfer unit 14 includes a first unit securing portion 31 (the first positioning portion). The imaging frame 10F includes a first frame securing portion 32 (the first positioning portion and a fourth positioning portion). The first unit securing portion 31 and the first frame securing portion 32 constitute the first positioning portions of the disclosure.

The first unit securing portion 31 is arranged on a rear end side of the unit right wall 14R of the intermediate transfer unit 14. Similarly, the first frame securing portion 32 is arranged on the frame right wall 10FR of the imaging frame 10F so as to be opposed to the first unit securing portion 31 in the vertical direction.

As illustrated in FIG. 6D, the first unit securing portion 31 is an approximately rectangular-parallelepiped-shaped protrusion protruding from the unit right wall 14R. The right-side surface and the lower surface portion of the first unit securing portion 31 are open. The first unit securing portion 31 internally forms a protrusion housing 31S. The first frame securing portion 32 is inserted into the protrusion housing 31S via the lower surface portion of the first unit securing portion 31.

The first unit securing portion 31 includes a bent rib 310, a first top panel 31T, and a first front surface portion 31F. The bent rib 310 is a rib part arranged at a lower right of the first unit securing portion 31. The first top panel 31T is a top panel that defines the top surface portion of the first unit securing portion 31. The first front surface portion 31F defines the front surface portion of the first unit securing portion 31.

Meanwhile, with reference to FIGS. 6C and 6E, the first frame securing portion 32 is a protrusion protruded upward from the top surface portion of the frame right wall 10FR. The first frame securing portion 32 has four surfaces facing the front, rear, right, and left. The first frame securing portion 32 has a protrusion front surface portion 32A, a protrusion rear surface portion 32B, and a protrusion right surface portion 32R.

As described above, when the intermediate transfer unit 14 is mounted to the imaging frame 10F from upward, the first frame securing portion 32 enters the inside of the first unit securing portion 31. The protrusion front surface portion 32A of the first frame securing portion 32 is brought into abutment with the first front surface portion 31F (see FIG. 6D) of the first unit securing portion 31. The protrusion rear surface portion 32B of the first frame securing portion 32 is brought into abutment with a surface opposed to the first front surface portion 31F in the first unit securing portion 31. This positions and secures the unit right wall 14R side of the intermediate transfer unit 14 to the imaging frame 10F in the front-rear direction.

Figure 7A:
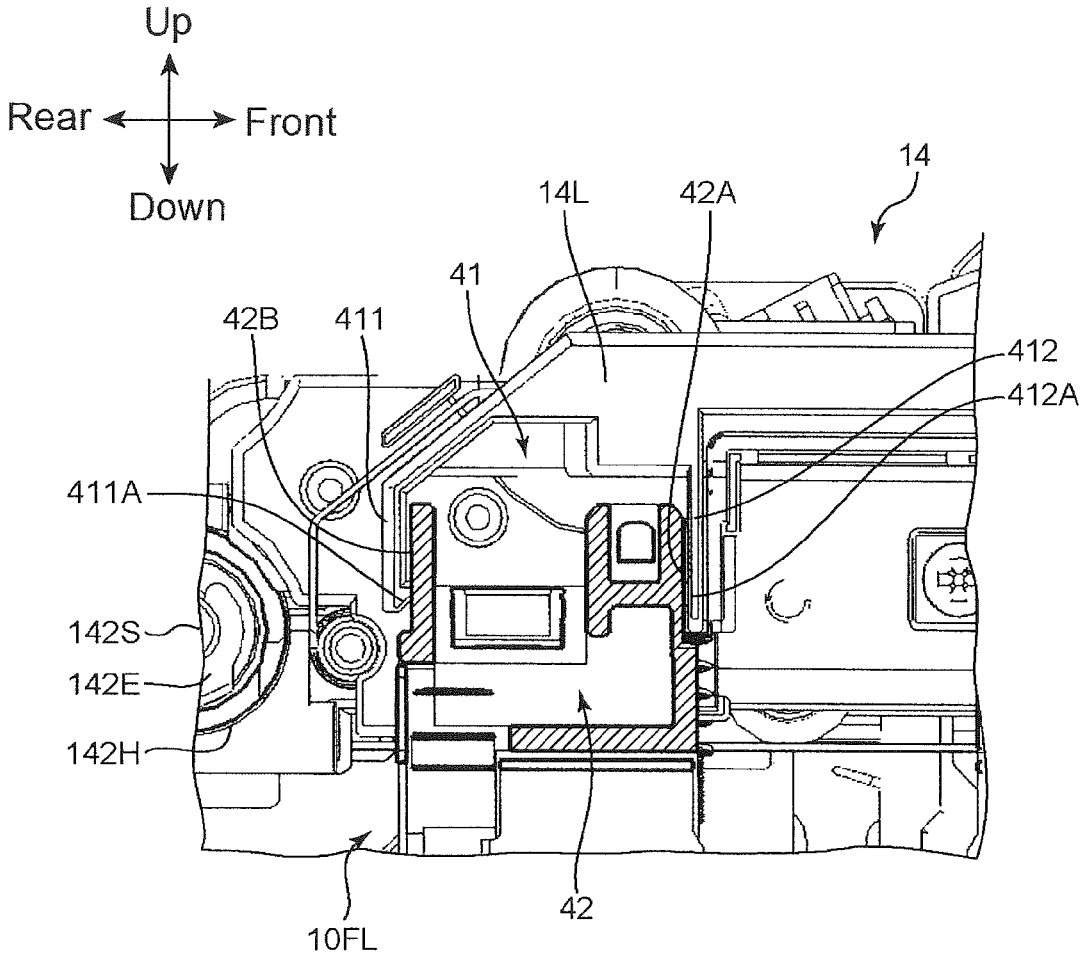
FIG. 7A illustrates a side cross section of other first positioning portions of the image forming apparatus according to the one embodiment.
Figure 7B:
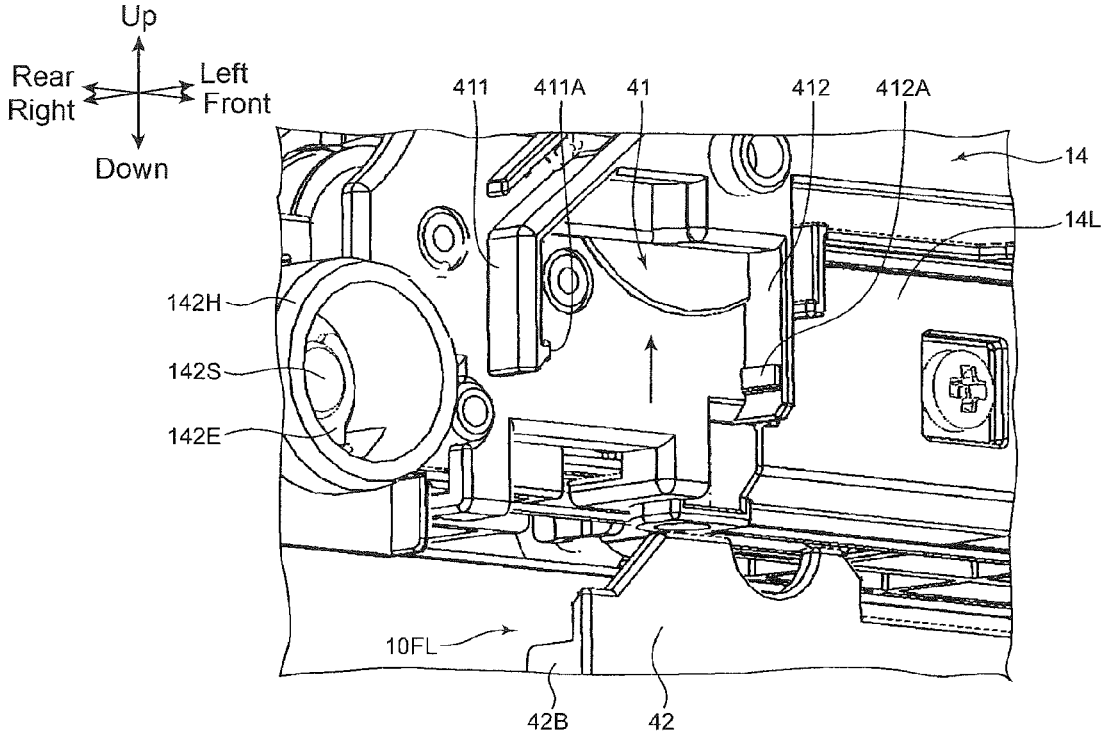
FIG. 7B obliquely illustrates the exploded first positioning portions according to the one embodiment.
Figure 7C:
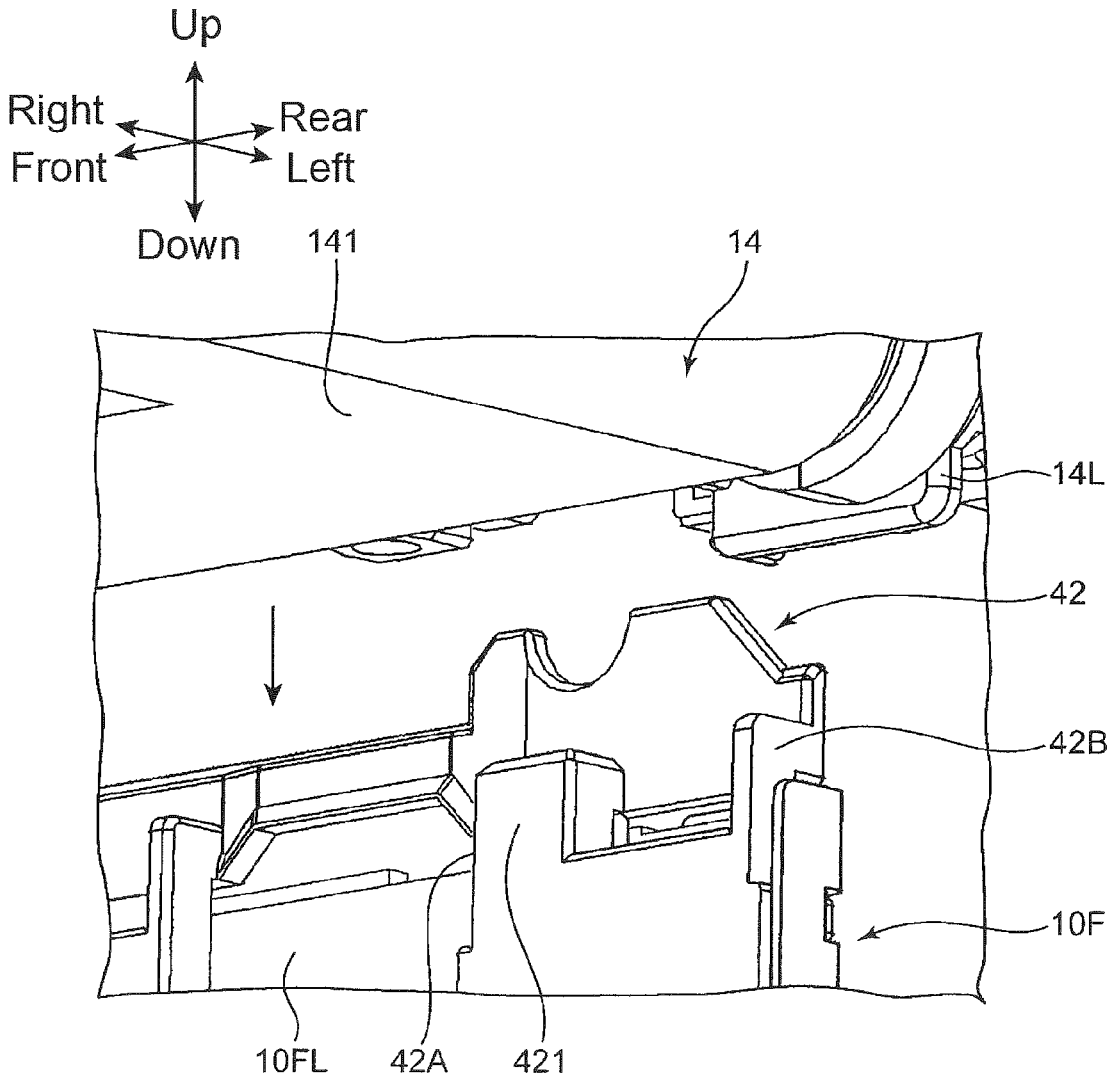
FIG. 7C obliquely illustrates the exploded first positioning portion according to the one embodiment.

FIG. 7A illustrates a side cross section of other first positioning portions of the image forming apparatus 1 according to the embodiment. FIG. 7B obliquely illustrates the first positioning portions illustrated in FIG. 7A. FIG. 7C obliquely illustrates the first positioning portion illustrated in FIG. 7A.

With reference to FIGS. 7A to 7C, the intermediate transfer unit 14 includes a second unit securing portion 41 (the first positioning portion). The imaging frame 10F includes a second frame securing portion 42 (the first positioning portion). The second unit securing portion 41 and the second frame securing portion 42 constitute the first positioning portions of the disclosure together with the above-described first unit securing portion 31 and first frame securing portion 32.

The second unit securing portion 41 is arranged at a rear end side of the unit left wall 14L of the intermediate transfer unit 14. Similarly, the second frame securing portion 42 is arranged at the frame left wall 10FL of the imaging frame 10F opposed to the second unit securing portion 41 in the vertical direction.

The second unit securing portion 41 is an approximately U-shaped protrusion protruded from the unit left wall 14L. As illustrated in FIG. 7B, the second unit securing portion 41 is arranged immediately front side of a drive roller shaft 142S of the drive roller 142. The second unit securing portion 41 includes a rear rib 411 and a front rib 412. The rear rib 411 and the front rib 412 are arranged with an interval in the front-rear direction and each extend in the vertical direction. The second frame securing portion 42 is inserted between the rear rib 411 and the front rib 412. The rear rib 411 includes a rear protrusion 411A. The front rib 412 includes a front protrusion 412A. The rear protrusion 411A and the front protrusion 412A are claws protruding from the rear rib 411 and the front rib 412 opposed to one another.

Meanwhile, the second frame securing portion 42 is arranged at a back side (an inner surface portion) of the frame left wall 10FL (see FIG. 7C). The second frame securing portion 42 includes a front regulating surface 42A and a rear regulating surface 42B. The front regulating surface 42A and the rear regulating surface 42B are wall surfaces located upright facing to the opposite side from one another in the front-rear direction. The front regulating surface 42A is equivalent to a front surface portion of a rectangular-parallelepiped-shaped inner projection 421, which protrudes at a back surface of the frame left wall 10FL. An interval between the front regulating surface 42A and the rear regulating surface 42B in the front-rear direction is configured to be approximately equal to an interval between the rear rib 411 and the front rib 412 of the second unit securing portion 41.

As described above, when the intermediate transfer unit 14 is mounted to the imaging frame 10F from upward (see an arrow in FIG. 7C), the second frame securing portion 42 enters the inside of the second unit securing portion 41 (see an arrow in FIG. 7B). As illustrated in FIG. 7A, the rear regulating surface 42B of the second frame securing portion 42 is brought into abutment with the rear protrusion 411A of the rear rib 411, and the front regulating surface 42A is brought into abutment with the front protrusion 412A of the front rib 412. This positions and secures the unit left wall 14L side of the intermediate transfer unit 14 to the imaging frame 10F in the front-rear direction.

As described above, in this embodiment, mounting the intermediate transfer unit 14 to the imaging frame 10F secures the position of the intermediate transfer unit 14 in the front-rear direction with respect to the imaging frame 10F by the first unit securing portion 31, the first frame securing portion 32, the second unit securing portion 41, and the second frame securing portion 42. Mounting the imaging frame 10F to the apparatus main body 11 secures the position of the intermediate transfer unit 14 in the front-rear direction inside the apparatus main body 11 via the imaging frame 10F. A displacement of the intermediate transfer unit 14 in the front-rear direction displaces the primary transfer rollers 24 for respective colors inside the intermediate transfer unit 14 and the photoreceptor drums 20 for respective colors. This embodiment ensures an accurate positioning between the primary transfer rollers 24 inside the intermediate transfer unit 14 and the photoreceptor drums 20 without via the components inside the apparatus main body 11. This excellently maintains a parallelism of the primary transfer rollers 24 with the photoreceptor drums 20 (a degree of parallelism between the respective shaft centers). Accordingly, toner images are accurately transferred from the respective photoreceptor drums 20 to the intermediate transfer belt 141. This restrains a deviation of toner images with a plurality of colors on the intermediate transfer belt 141.

Second Positioning Portions

Figure 8A:
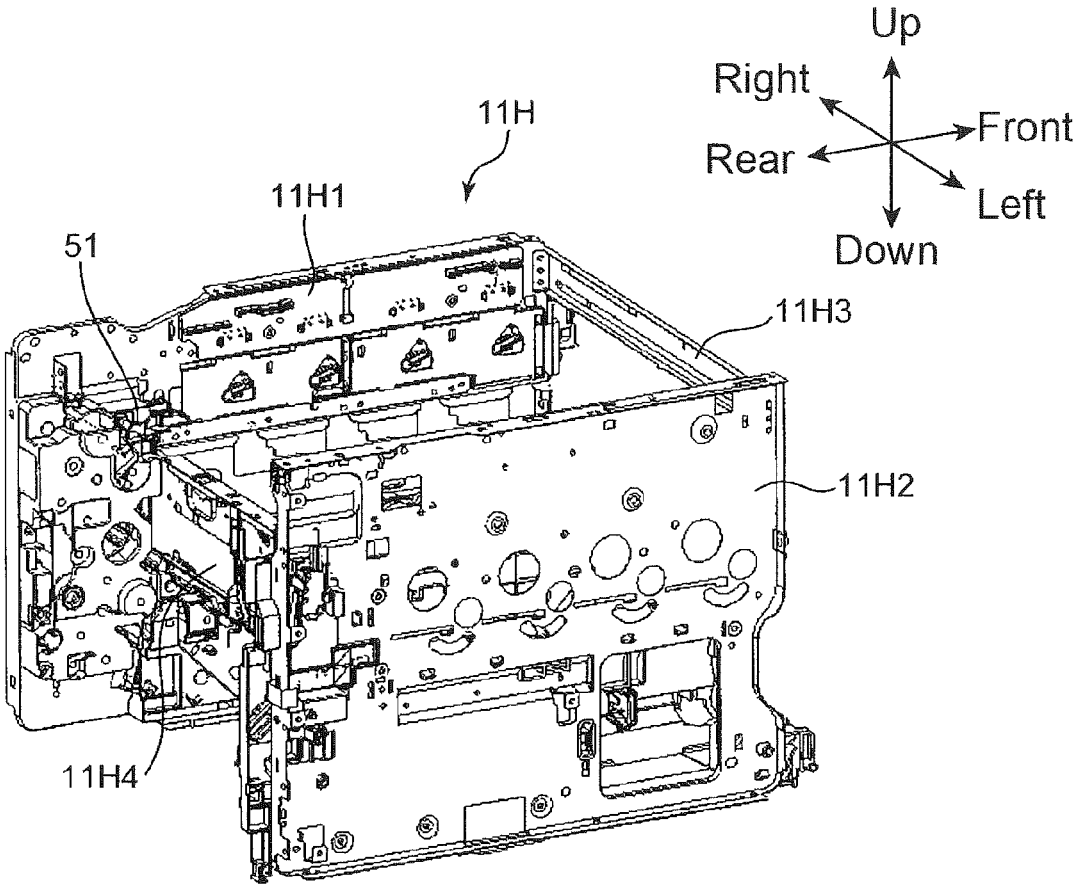
FIG. 8A obliquely illustrates a main body frame of the image forming apparatus according to the one embodiment.
Figure 8B:
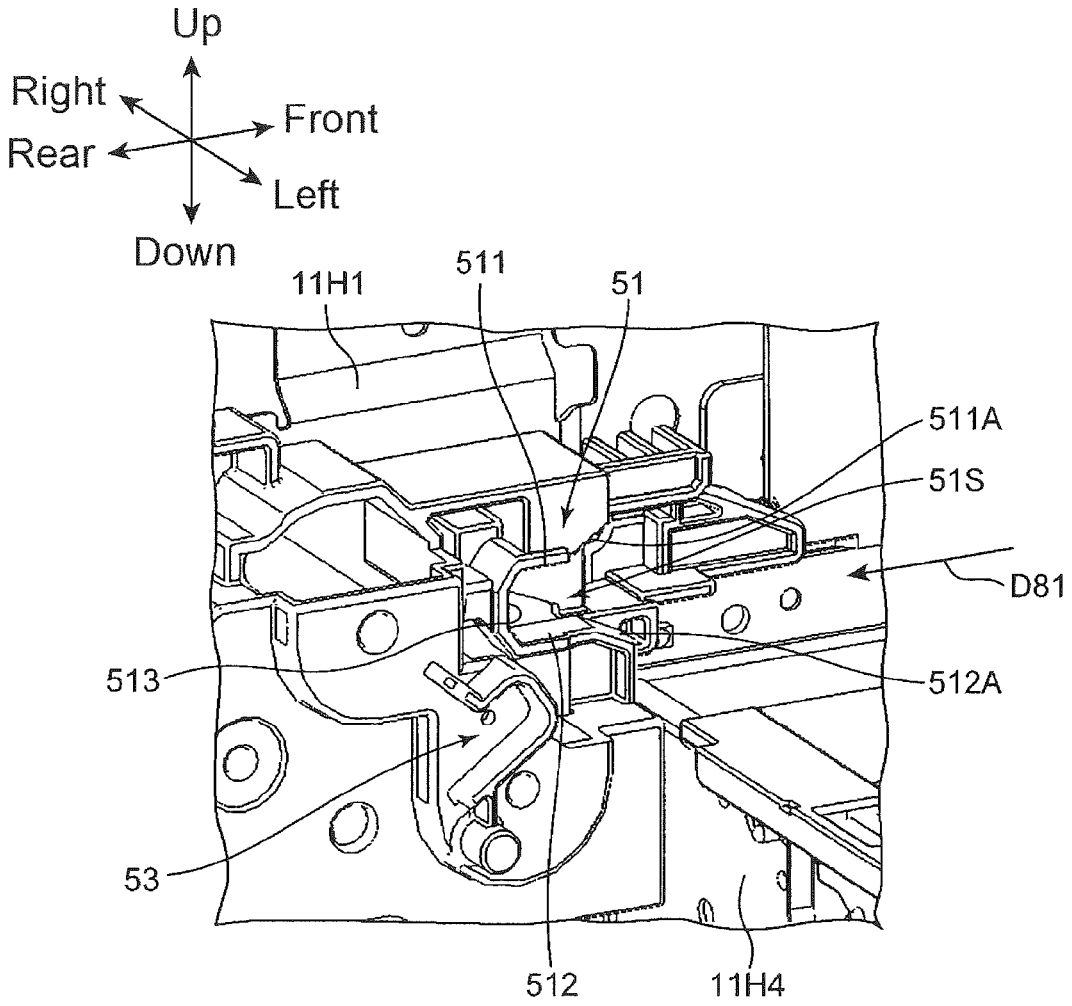
FIG. 8B obliquely illustrates a partially enlarged main body frame according to the one embodiment.
Figure 8C:
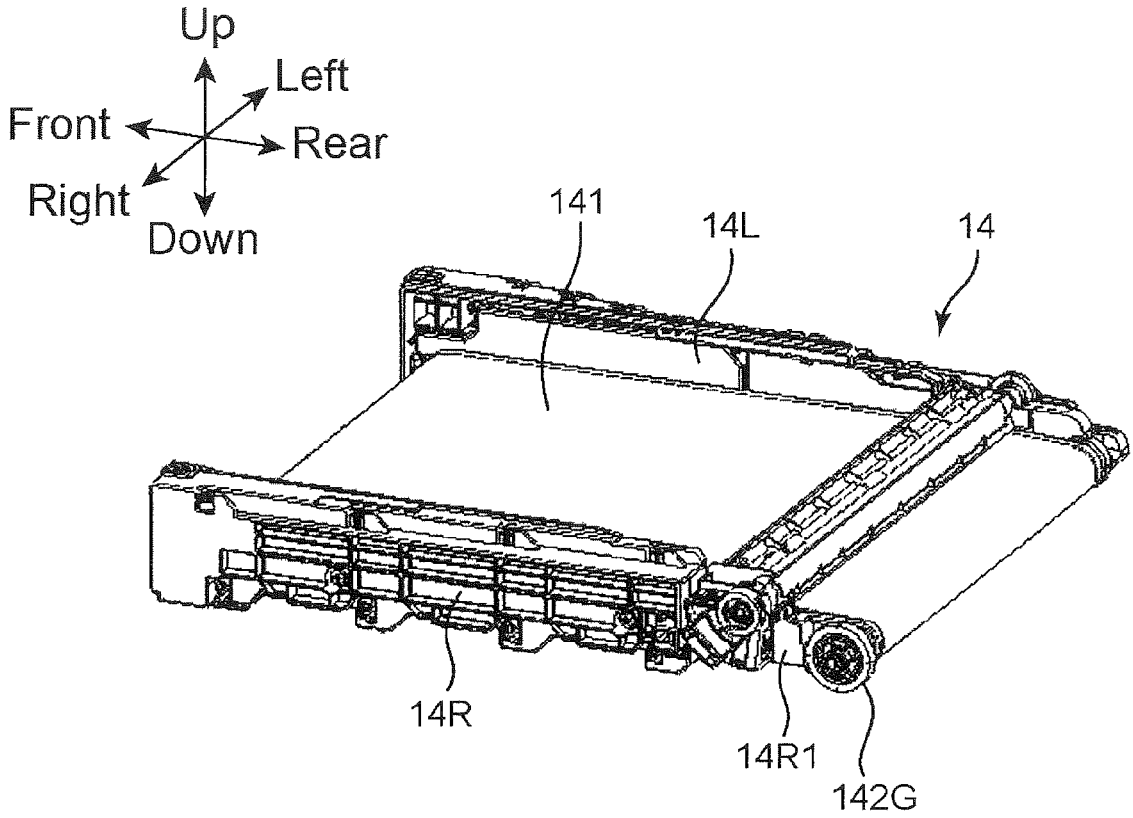
FIG. 8C obliquely illustrates the intermediate transfer unit according to the one embodiment.
Figure 8D:
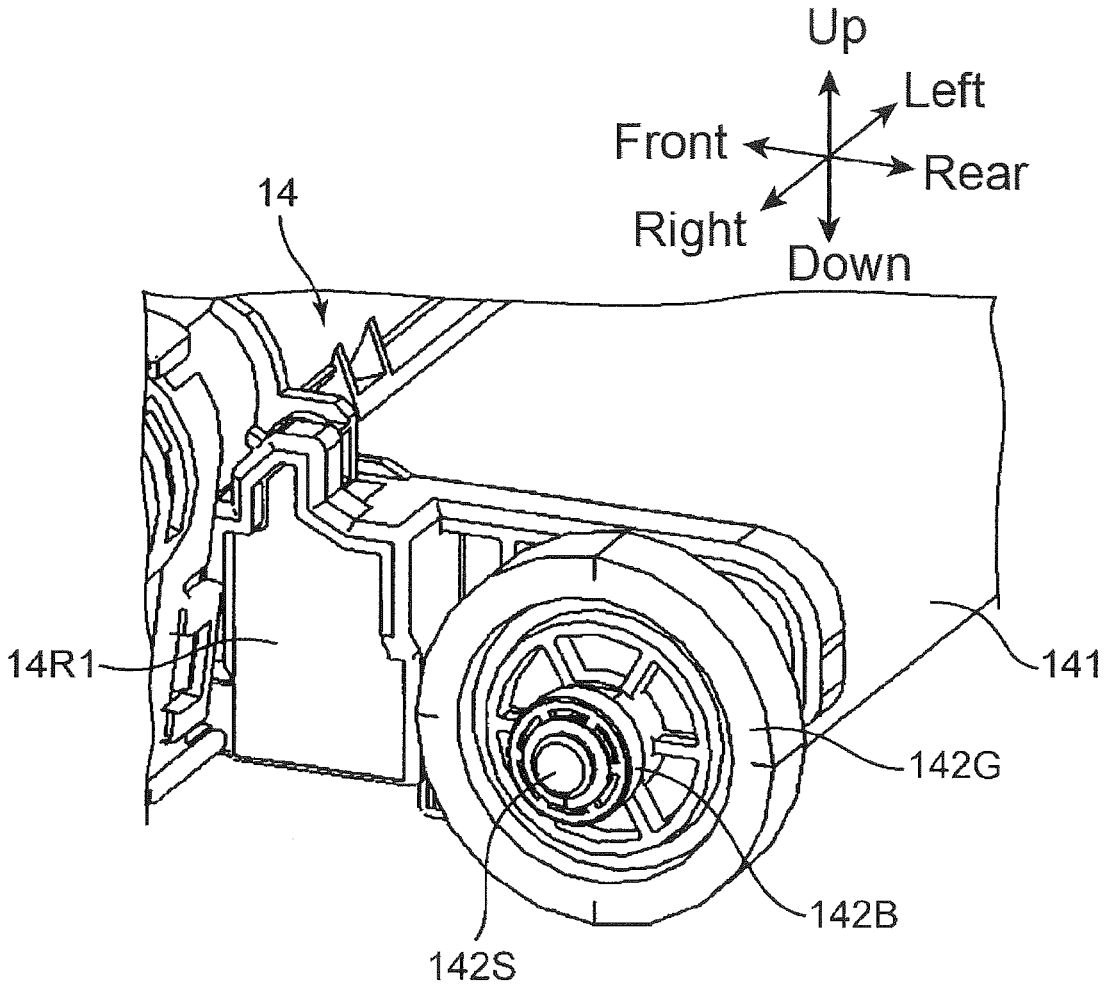
FIG. 8D obliquely illustrates the partially enlarged intermediate transfer unit according to the one embodiment.
Figure 8E:
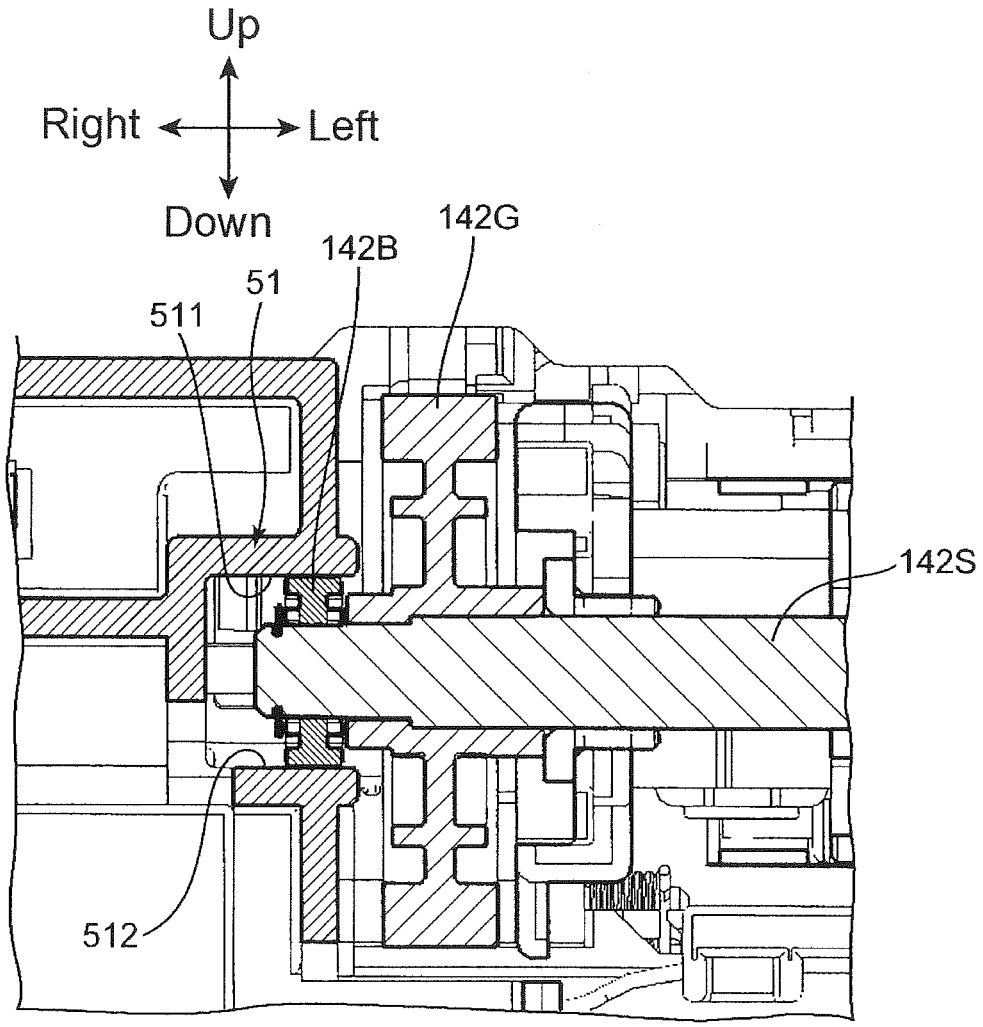
FIG. 8E illustrates a cross section of one of second positioning portions of the image forming apparatus according to the one embodiment.

The image forming unit 10 further includes the second positioning portions. The second positioning portions are arranged at the intermediate transfer unit 14 and the apparatus main body 11 to position the distal end side (the rear end side) in the mounting direction of the intermediate transfer unit 14 in the vertical direction (a third direction, a direction intersecting with the first direction and the second direction) inside the apparatus main body 11. The apparatus main body 11 includes a main body frame 11H. The main body frame 11H is a metal frame constituting the apparatus main body 11. FIG. 8A obliquely illustrates the main body frame 11H of the image forming apparatus according to the embodiment. FIG. 8B obliquely illustrates the partially enlarged main body frame 11H illustrated in FIG. 8A. FIG. 8C obliquely illustrates the intermediate transfer unit 14. FIG. 8D obliquely illustrates the partially enlarged intermediate transfer unit 14 illustrated in FIG. 80. FIG. 8E illustrates a cross section of one of the second positioning portions of the image forming unit 10.

With reference to FIG. 8A, the main body frame 11H has an approximately rectangular parallelepiped shape. The main body frame 11H internally houses the respective units of the image forming unit 10. The main body frame 11H has a right main body frame 11H1, a left main body frame 11H2, a front main body frame 11H3, and a rear main body frame 11H4. The right main body frame 11H1 and the left main body frame 11H2 are sheet metals each have an approximately rectangular shape and are located upright in the vertical direction. The front main body frame 11H3 and the rear main body frame 11H4 are frames connecting the right main body frame 11H1 and the left main body frame 11H2 at the front and the rear of the main body frame 11H. In FIG. 8A, the above-described image forming unit 10 passes through below the front main body frame 11H3 from the front of the main body frame 11H and is mounted to the inside of the main body frame 11H.

The main body frame 11H includes a bearing securing portion 51 (see FIGS. 8A and 8B) (the second positioning portion, a fitted portion). The bearing securing portion 51 constitutes one of the second positioning portions of the embodiment. The bearing securing portion 51 is arranged near an upper end portion of the rear main body frame 11H4 at an inner wall surface (a left-side surface) of the right main body frame 11H1. As illustrated in FIG. 8B, the bearing securing portion 51 has an approximately U-shaped part whose front side is open. A bearing entering portion 51S is formed at this U-shaped part. To the bearing entering portion 51S, a bearing 142B, which will be described later, is fitted. To define the bearing entering portion 51S, the bearing securing portion 51 has an upper right regulating surface 511, a lower right regulating surface 512, and a right rear regulating surface 513. The upper right regulating surface 511 defines a top surface portion of the bearing entering portion 51S. The lower right regulating surface 512 is arranged below the upper right regulating surface 511 and defines the lower surface portion of the bearing entering portion 51S. The upper right regulating surface 511 and the lower right regulating surface 512 are formed of planar surfaces extending in the front-rear direction (the horizontal direction). The right rear regulating surface 513 connects rear end portions of the upper right regulating surface 511 and the lower right regulating surface 512 in the vertical direction. An upper right taper 511A is connected to a front end portion of the upper right regulating surface 511. The upper right taper 511A is formed of an inclined surface inclining downward to the end along the mounting direction (see an arrow D81 in FIG. 8B) of the image forming unit 10. Similarly, a lower right taper 512A, which is formed of an inclined surface inclining upward to the end along the mounting direction of the image forming unit 10, is connected to a front end portion of the lower right regulating surface 512.

Further, the bearing securing portion 51 includes a secondary transfer roller right bearing portion 53. The secondary transfer roller right bearing portion 53 is arranged below the bearing entering portion 51S. The secondary transfer roller right bearing portion 53 is a groove that has an inclined shape inclining upward to the end from downward and rearward to upward and forward. The secondary transfer roller right bearing portion 53 rotatably journals one end of a shaft (not illustrated) of the secondary transfer roller 26. Consequently, the bearing securing portion 51 also has a function to position the secondary transfer roller 26 inside the apparatus main body 11. The secondary transfer roller 26 is biased toward the drive roller 142 of the intermediate transfer unit 14 mounted inside the apparatus main body 11 with a spring (not illustrated).

With reference to FIGS. 8C and 8D, the intermediate transfer unit 14 includes a driving roller gear 142G and the bearing 142B (a cylinder portion) (the second positioning portion, the cylinder portion). The above-described unit right wall 14R includes a right distal end wall 14R1. The right distal end wall 14R1 is equivalent to a rear end portion of the unit right wall 14R. The drive roller shaft 142S, which is the rotation shaft of the drive roller 142, is journaled to the right distal end wall 14R1. The driving roller gear 142G is a gear secured to the drive roller shaft 142S opposed to a right-side surface of the right distal end wall 14R1. FIG. 8D omits gear teeth arranged on an outer peripheral surface of the driving roller gear 142G. Mounting the image forming unit 10 including the intermediate transfer unit 14 to the apparatus main body 11 connects the driving roller gear 142G to a driving motor (not illustrated). This rotationally drives the drive roller 142 via the driving roller gear 142G, circularly driving the intermediate transfer belt 141.

The bearing 142B is arranged on the shaft center of the drive roller shaft 142S so as to be adjacent to the driving roller gear 142G. The bearing 142B is a ball bearing externally fitted to the drive roller shaft 142S. The bearing 142B constitutes one of the second positioning portions according to this embodiment together with the above-described bearing securing portion 51.

When the image forming unit 10 including the intermediate transfer unit 14 is mounted inside the apparatus main body 11, the bearing 142B of the intermediate transfer unit 14 enters the bearing entering portion 51S along an arrow D81 direction shown in FIG. 8B. The upper right taper 511A and the lower right taper 512A smoothly achieve the entrance of the bearing 142B. As illustrated in FIG. 8E, an upper end portion of the bearing 142B is brought into abutment with the upper right regulating surface 511, and a lower end portion of the bearing 142B is brought into abutment with the lower right regulating surface 512. Consequently, fitting the bearing 142B to the bearing securing portion 51 secures the position of the drive roller 142 in the vertical direction at a right end side of the intermediate transfer unit 14.

Figure 9A:
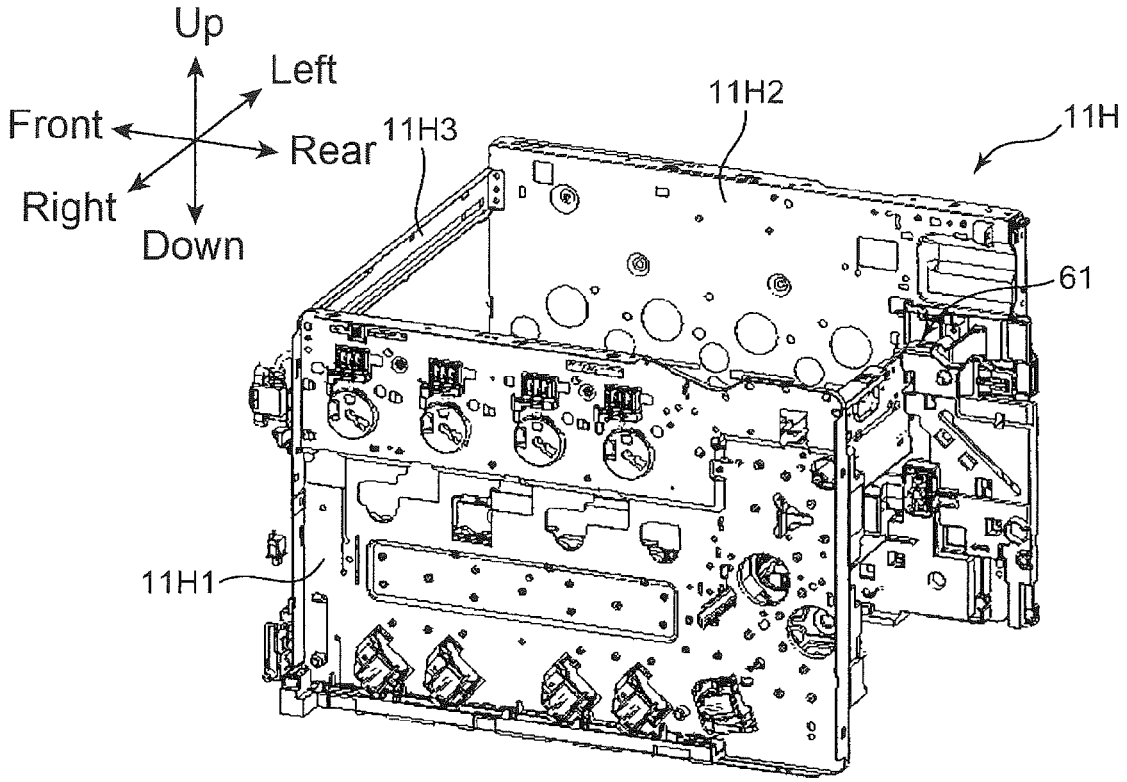
FIG. 9A obliquely illustrates a main body frame of the image forming apparatus according to the one embodiment.
Figure 9B:
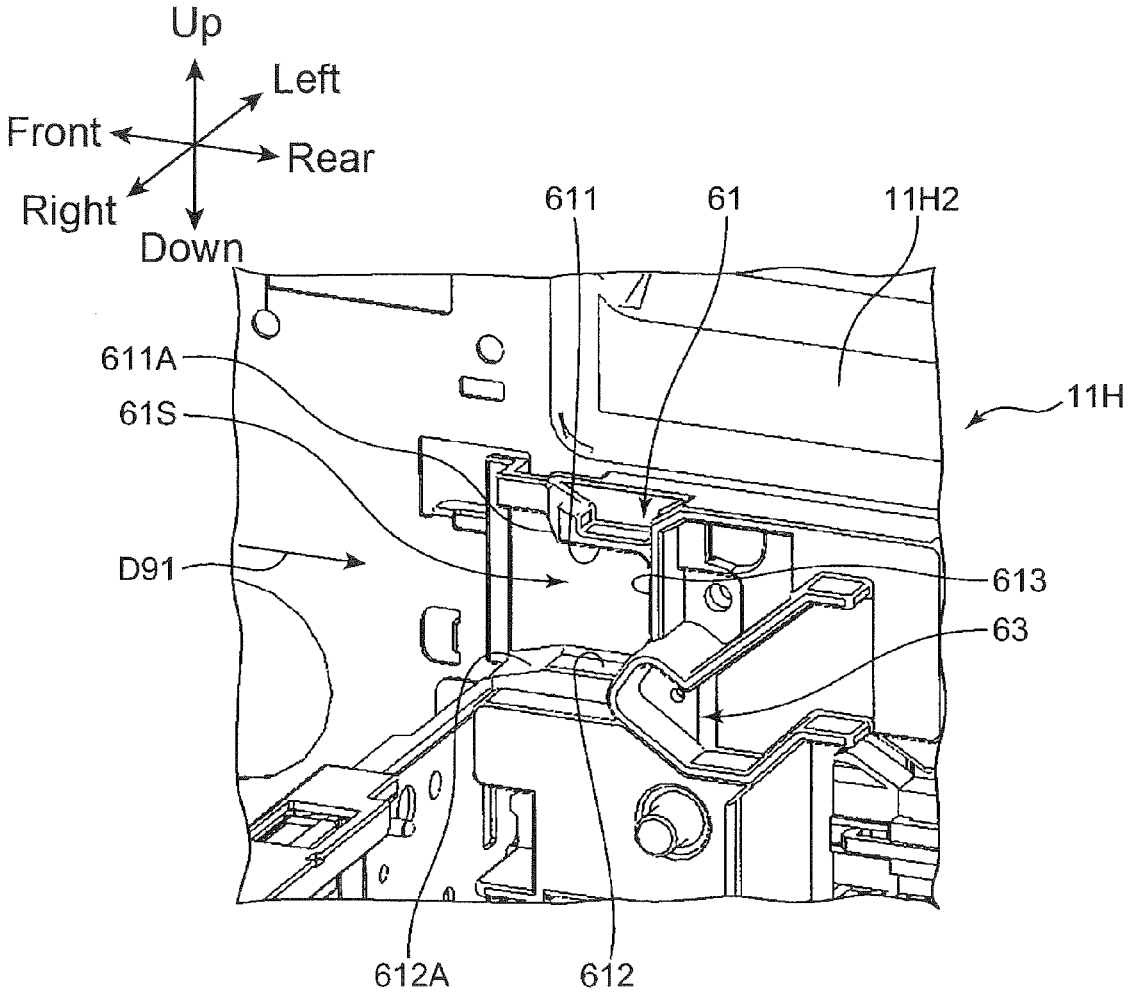
FIG. 9B obliquely illustrates a partially enlarged main body frame according to the one embodiment.
Figure 9C:
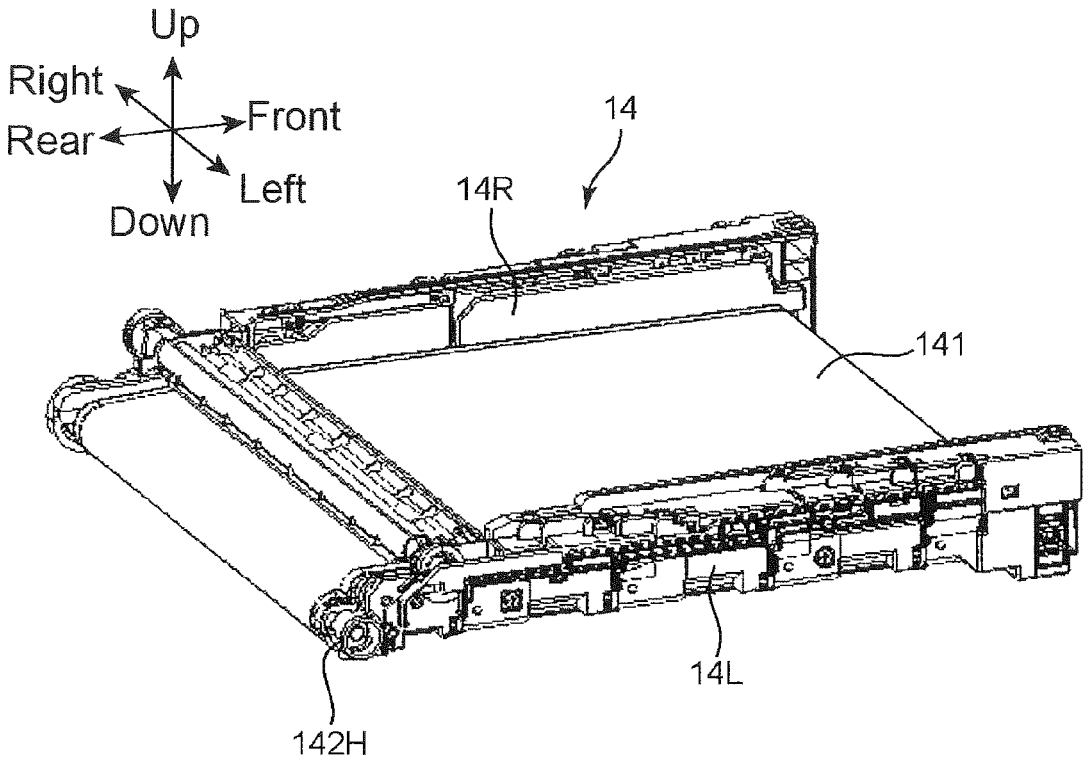
FIG. 9C obliquely illustrates an intermediate transfer unit according to the one embodiment.
Figure 9D:
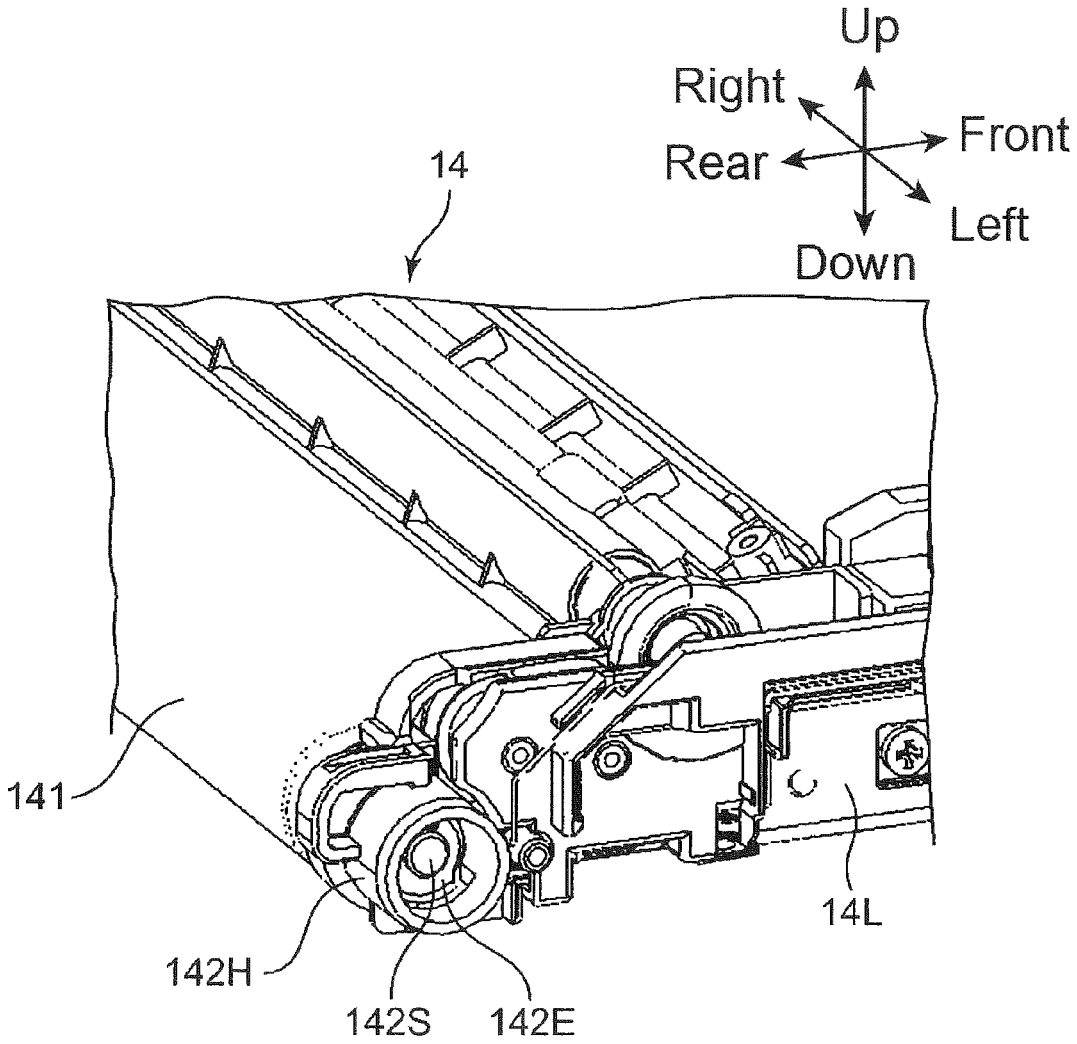
FIG. 9D obliquely illustrates a partially enlarged intermediate transfer unit according to the one embodiment.
Figure 9E:
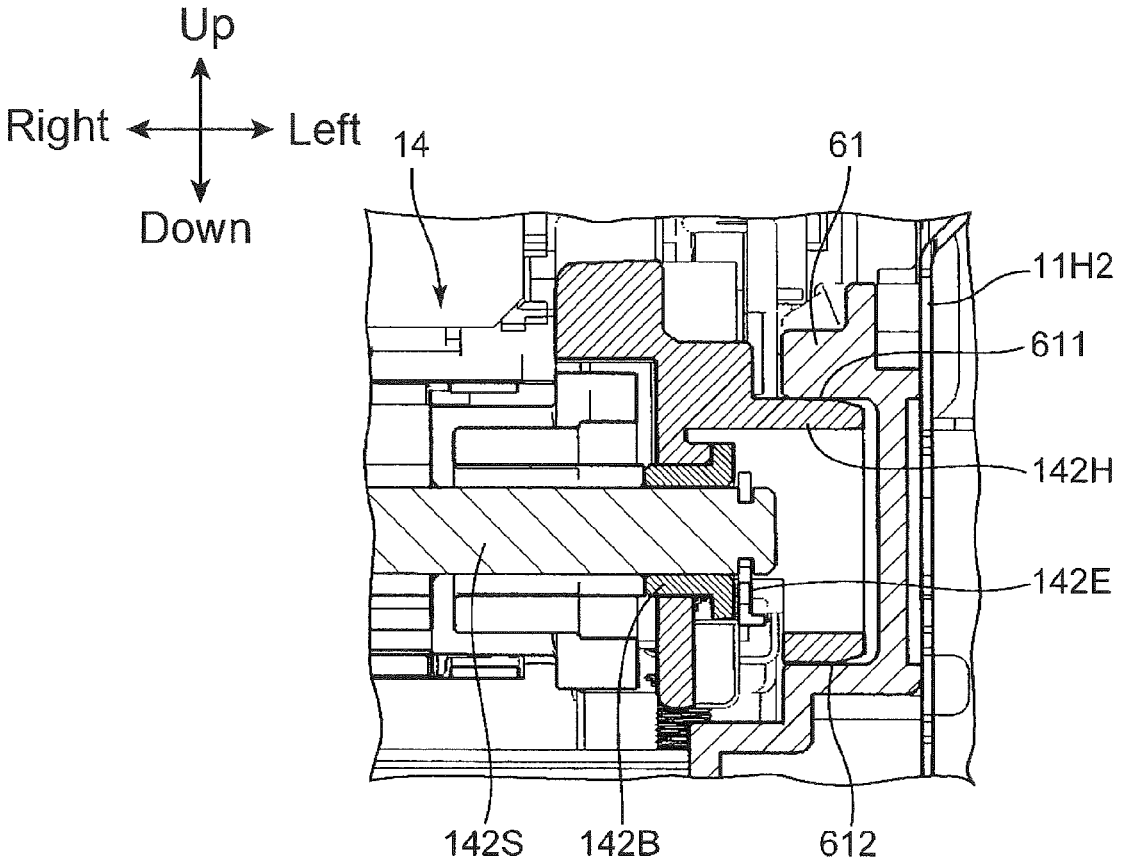
FIG. 9E illustrates a cross section of another of the second positioning portions of the image forming apparatus according to the one embodiment.

FIG. 9A obliquely illustrates the main body frame 11H of the image forming apparatus 1 according to the embodiment. FIG. 9B obliquely illustrates the partially enlarged main body frame 11H illustrated in FIG. 9A. FIG. 9C obliquely illustrates the intermediate transfer unit 14 according to the embodiment. FIG. 9D obliquely illustrates the partially enlarged intermediate transfer unit 14 illustrated in FIG. 9C. FIG. 9E illustrates a cross section of another of the second positioning portions of the image forming apparatus 1 according to the embodiment.

The main body frame 11H includes a sleeve securing portion 61 (see FIGS. 9A and 9B) (the second positioning portion, the fitted portion). The sleeve securing portion 61 constitutes another of the second positioning portion of the embodiment. The sleeve securing portion 61 is arranged near an upper end portion of the rear main body frame 11H4 at an inner wall surface (a right-side surface) of the left main body frame 11H2. As illustrated in FIG. 9B, the sleeve securing portion 61 has an approximately U-shaped part whose front side is open. A sleeve entrance portion 61S is formed at this U-shaped part. To the sleeve entrance portion 61S, a drive roller sleeve 142H (see FIG. 9D) is fitted. To define the sleeve entrance portion 61S, the sleeve securing portion 61 has an upper left regulating surface 611, a lower left regulating surface 612, and a left rear regulating surface 613. The upper left regulating surface 611 defines a top surface portion of the sleeve entrance portion 61S. The lower left regulating surface 612 is arranged below the upper left regulating surface 611 and defines the lower surface portion of the sleeve entrance portion 61S. The upper left regulating surface 611 and the lower left regulating surface 612 are formed of planar surfaces extending in the front-rear direction (the horizontal direction). The left rear regulating surface 613 connects rear end portions of the upper left regulating surface 611 and the lower left regulating surface 612 in the vertical direction. An upper left taper 611A is connected to a front end portion of the upper left regulating surface 611. The upper left taper 611A is formed of an inclined surface inclining downward to the end along the mounting direction (see an arrow D91 in FIG. 9B) of the image forming unit 10. Similarly, a lower left taper 612A, which is formed of an inclined surface inclining upward to the end along the mounting direction of the image forming unit 10, is connected to a front end portion of the lower left regulating surface 612.

Further, the sleeve securing portion 61 includes a secondary transfer roller left bearing portion 63. The secondary transfer roller left bearing portion 63 is arranged below the sleeve entrance portion 61S. The secondary transfer roller left bearing portion 63 is a groove that has an inclined shape inclining upward to the end from downward and rearward to upward and forward. The secondary transfer roller left bearing portion 63 rotatably journals the other end of the shaft (not illustrated) of the secondary transfer roller 26. Consequently, the sleeve securing portion 61 also has a function to position the secondary transfer roller 26 inside the apparatus main body 11. The left end portion of the secondary transfer roller 26 is also biased toward the drive roller 142 of the intermediate transfer unit 14 mounted inside the apparatus main body 11 with the spring (not illustrated).

With reference to FIGS. 9C and 9D, the intermediate transfer unit 14 includes the drive roller sleeve 142H (the second positioning portion, the cylinder portion), a C clip 142E, and the above-described bearing 142B. A left end portion of the drive roller shaft 142S is journaled to a rear end portion of the unit left wall 14L.

The above-described bearing 142B is arranged on the shaft center of the drive roller shaft 142S on the unit left wall 14L side as well (see FIG. 9E). The bearing 142B is a ball bearing externally fitted to the drive roller shaft 142S.

The drive roller sleeve 142H is arranged radially outside the bearing 142B. The drive roller sleeve 142H includes a shaft hole (not illustrated) into which the bearing 142B is inserted. In this embodiment, the drive roller sleeve 142H is constituted of a part of the unit left wall 14L and is resin-molded integrally with the unit left wall 14L. As illustrated in FIGS. 9D and 9E, the drive roller sleeve 142H has a cylindrical shape extending to the left at radially outside the bearing 142B. The drive roller sleeve 142H constitutes another second positioning portion of this embodiment. The C clip 142E is fitted to the drive roller shaft 142S at radially outside (a left end side of) the bearing 142B. The C clip 142E prevents a detachment of the bearing 142B.

When the image forming unit 10 including the intermediate transfer unit 14 is mounted inside the apparatus main body 11, the drive roller sleeve 142H of the intermediate transfer unit 14 enters the sleeve entrance portion 61S along an arrow D91 direction shown in FIG. 9B. The upper left taper 611A and the lower left taper 612A smoothly achieve the entrance of the drive roller sleeve 142H. As illustrated in FIG. 9E, an upper end portion of the drive roller sleeve 142H is brought into abutment with the upper left regulating surface 611, and a lower end portion of the drive roller sleeve 142H is brought into abutment with the lower left regulating surface 612. Consequently, fitting the drive roller sleeve 142H to the sleeve securing portion 61 secures the position of the drive roller 142 in the vertical direction at the left end side of the intermediate transfer unit 14.

As described above, this embodiment achieves the positioning of the distal end side (the rear end side) in the mounting direction of the intermediate transfer unit 14 in the vertical direction (the third direction) by the second positioning portions arranged at the intermediate transfer unit 14 and the apparatus main body 11. This ensures the accurate positioning between the drive roller 142 of the intermediate transfer unit 14 and the secondary transfer rollers 26 on the apparatus main body 11 side without via the imaging frame 10F. Especially, in this embodiment, fitting the bearing 142B and the drive roller sleeve 142H on a right side to the bearing securing portion 51 and the sleeve securing portion 61, respectively, ensures the accurate positioning of the drive roller 142 of the intermediate transfer unit 14 in the apparatus main body 11. Further, both the bearing securing portion 51 and the sleeve securing portion 61 include the secondary transfer roller right bearing portion 53 and the secondary transfer roller left bearing portion 63, which rotatably support the secondary transfer roller 26. This ensures further accurately positioning the drive roller 142 of the intermediate transfer unit 14 with the secondary transfer roller 26 on the apparatus main body 11 side. As described above, the first positioning portions position the direction of connecting the axis lines of the drive roller 142 and the secondary transfer roller 26 (the front-rear direction) in the intermediate transfer unit 14. Further, a biasing spring (not illustrated), which is provided with the secondary transfer roller 26, stably maintains a secondary transfer nip pressure of the drive roller 142 and the secondary transfer roller 26. Meanwhile, the above-described second positioning portions position the direction that approximately perpendicular to the direction of connecting the axis lines of the drive roller 142 and the secondary transfer roller 26 (the vertical direction, the third direction). This restrains a displacement of the secondary transfer nip portion in the sheet conveyance direction, secondarily transferring the toner image to sheets stably.

Third Positioning Portions

Figure 10A:
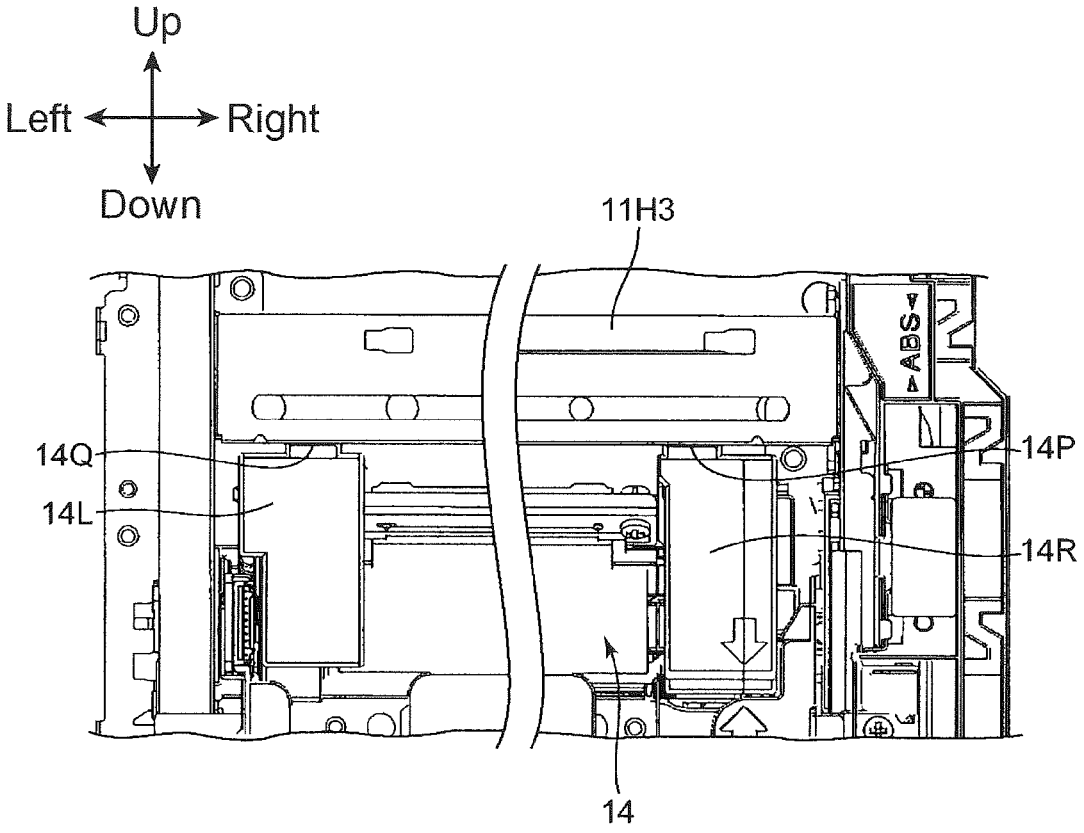
FIG. 10A illustrates a front surface of third positioning portions of the image forming apparatus according to the one embodiment.
Figure 10B:
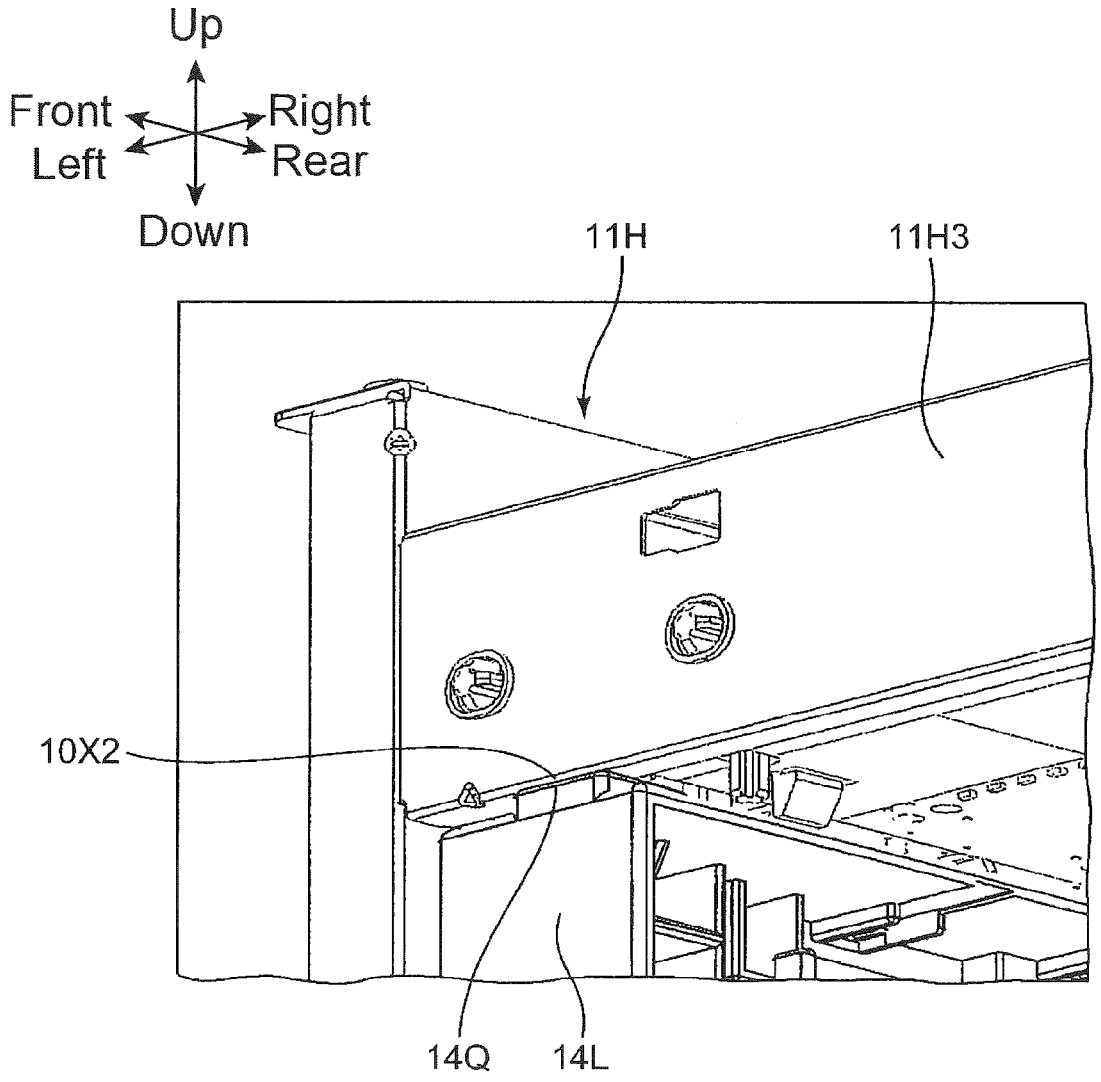
FIG. 10B obliquely illustrates one of third positioning portions of the image forming apparatus according to the one embodiment.
Figure 10C:
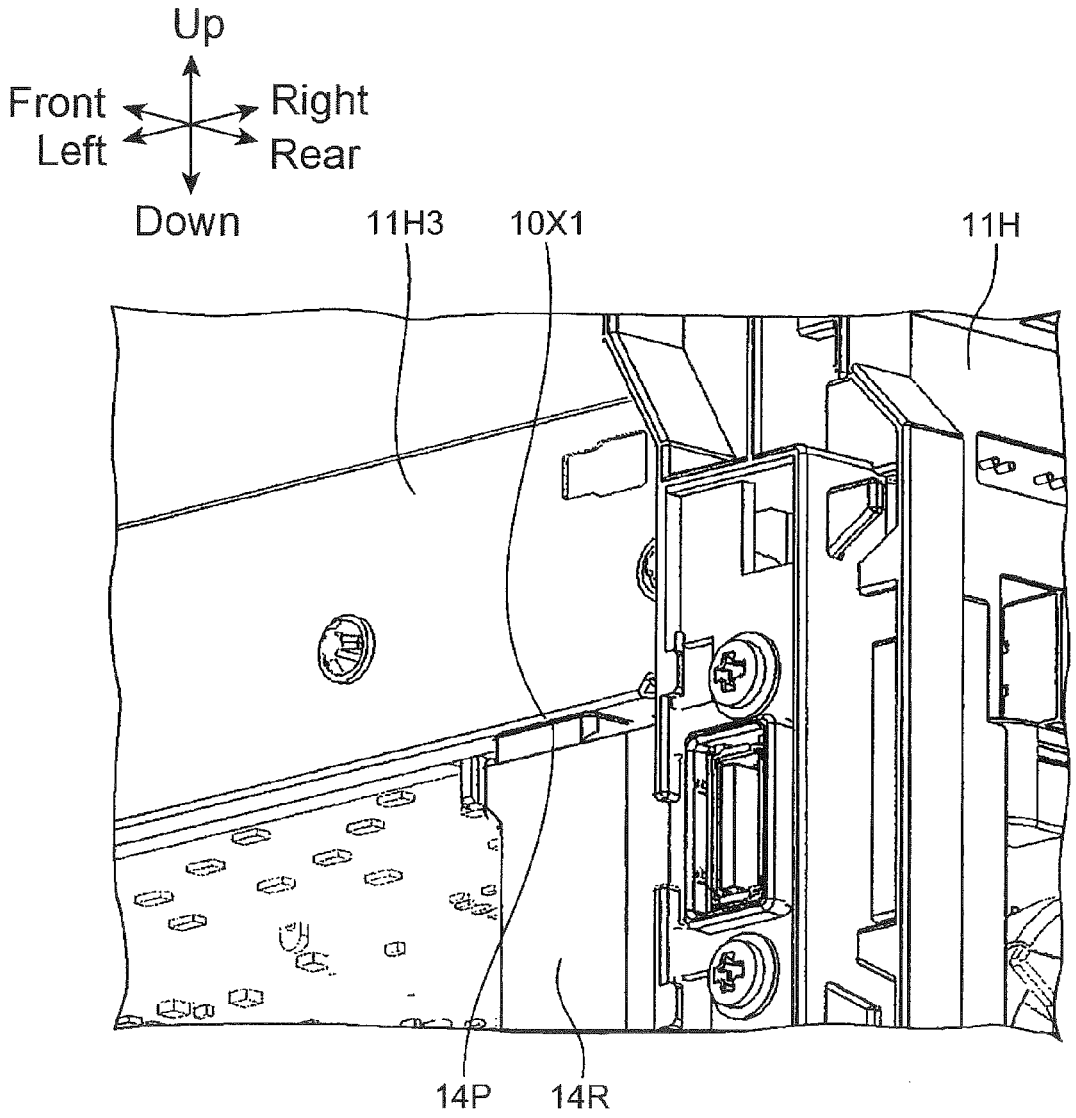
FIG. 10C obliquely illustrates another of the third positioning portions of the image forming apparatus according to the one embodiment.
Figure 10D:
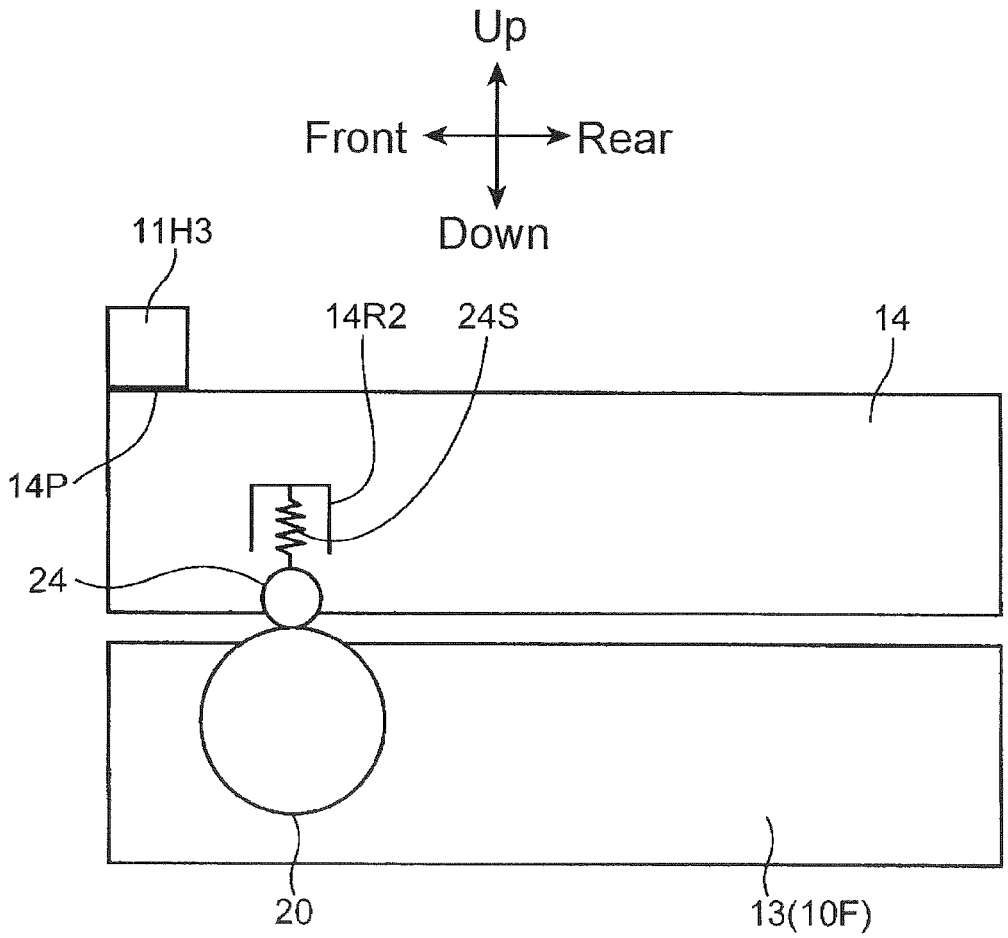
FIG. 10D schematically illustrates a state of positioning the third positioning portions of the image forming apparatus according to the one embodiment.

The image forming unit 10 further includes the third positioning portions. The third positioning portions are arranged at the intermediate transfer unit 14 and the apparatus main body 11 to position the rear end side (the front end side) of the intermediate transfer unit 14 in the mounting direction in the vertical direction (the third direction) inside the apparatus main body 11. FIG. 10A illustrates a front surface of the third positioning portions of the image forming apparatus 1 according to the embodiment. FIG. 10B obliquely illustrates one of the third positioning portion of the image forming apparatus 1. FIG. 10C obliquely illustrates another of the third positioning portions of the image forming apparatus 1. FIG. 10D schematically illustrates a state of positioning the third positioning portions of the image forming apparatus 1.

The intermediate transfer unit 14 includes a right abutting portion 14P (an abutting portion) and a left abutting portion 14Q (an abutting portion). The right abutting portion 14P is a thin sheet-shaped protrusion protruded upward from a front end portion of a top end surface of the unit right wall 14R. In top view, the right abutting portion 14P has a rectangular shape. Similarly, the left abutting portion 14Q is a thin sheet-shaped protrusion protruded upward from a front end portion of a top end surface of the unit left wall 14L. In top view, the left abutting portion 14Q has a rectangular shape. The right abutting portion 14P and the left abutting portion 14Q function as the pair of abutting portions arranged on the rear end side in the mounting direction of the intermediate transfer unit 14 with an interval in the lateral direction.

The apparatus main body 11 includes a right abutted portion 10X1 (see FIG. 100) (an abutted portion) and a left abutted portion 10X2 (see FIG. 10B) (an abutted portion). The right abutted portion 10X1 is equivalent to a right end portion of a lower end surface of the above-described front main body frame 11H3. Similarly, the left abutted portion 10X2 is equivalent to a left end portion of a lower end surface of the above-described front main body frame 11H3. The right abutted portion 10X1 and the left abutted portion 10X2 are arranged opposed to the right abutting portion 14P and the left abutting portion 14Q in the vertical direction, respectively. In this embodiment, the right abutting portion 14P, the left abutting portion 14Q, the right abutted portion 10X1, and the left abutted portion 10X2 constitute the third positioning portions.

With reference to FIG. 10D, the intermediate transfer unit 14 further includes roller biasing springs 24S (biasing members) and spring housings 14R2. The roller biasing spring 24S is a coil spring that biases the primary transfer roller 24 toward the photoreceptor drum 20. The biasing force by the roller biasing spring 24S stably maintains the primary transfer nip pressure. The spring housings 14R2 are U-shaped housings formed at the unit left wall 14L and the unit right wall 14R. The spring housing 14R2 houses the roller biasing spring 24S. As illustrated in FIG. 10D, the upper end portion of the roller biasing spring 24S is locked to an inner wall of the spring housing 14R2. Meanwhile, the lower end portion of the roller biasing spring 24S biases a shaft (not illustrated) of the primary transfer roller 24 downward. The roller biasing spring 24S and the spring housing 14R2 are arranged at both the respective end portions of the primary transfer roller 24 in the axial direction. Further, the plurality of roller biasing springs 24S and the plurality of spring housings 14R2 are arranged corresponding to the plurality of respective primary transfer rollers 24, which are provided for respective colors.

As illustrated in FIG. 10D, mounting the intermediate transfer unit 14 to the apparatus main body 11 presses the primary transfer roller 24 to the photoreceptor drum 20 by the biasing force from the roller biasing spring 24S. The reactive force at this time is given from the roller biasing spring 24S to the spring housing 14R2. Since the spring housings 14R2 are a part of the unit right wall 14R and the unit left wall 14L, the reactive force given to the spring housings 14R2 presses the right abutting portion 14P and the left abutting portion 14Q upward. Consequently, the right abutting portion 14P and the left abutting portion 14Q are each brought into abutment with the right abutted portion 10X1 and the left abutted portion 10X2. This secures the vertical position of the rear end side (the front end portion) in the mounting direction of the intermediate transfer unit 14. Thus, in this embodiment, without via the imaging frame 10F, using the biasing force from the roller biasing springs 24S, the rear end side in the mounting direction of the intermediate transfer unit 14 inside the apparatus main body 11 can be accurately positioned. In this respect, compared with the rear end side of the intermediate transfer unit 14, the vertical position of the intermediate transfer unit 14 is not strongly regulated. This restrains an interference of the position regulation to the rear end side of the intermediate transfer unit 14, that is, the positioning of the intermediate transfer unit 14 by the second positioning portions, by the third positioning portions.

Fourth Positioning Portions

The image forming unit 10 further includes the fourth positioning portions. The fourth positioning portions are arranged at the intermediate transfer unit 14 and the imaging frame 10F to position the intermediate transfer unit 14 in the lateral direction (the first direction) inside the apparatus main body 11. This embodiment includes the fourth positioning portions near the above-described first unit securing portion 31 and first frame securing portion 32 described as the first positioning portions. FIG. 6F, which is described above, illustrates a cross section viewing a region where the first frame securing portion 32 is inserted into the first unit securing portion 31 in a cut surface along the lateral direction. As illustrated in FIG. 6F, mounting the intermediate transfer unit 14 to the imaging frame 10F bringing the protrusion right surface portion 32R of the first frame securing portion 32 into abutment with a left end portion of the bent rib 310.

Further, the imaging frame 10F includes a frame right inner wall portion 34 (the fourth positioning portion). The frame right inner wall portion 34 is a wall portion arranged inside (the left side of) the frame right wall 10FR. Further, the frame right inner wall portion 34 includes an opposed surface 341. The opposed surface 341 is a wall surface facing the left side in the frame right inner wall portion 34. Meanwhile, the intermediate transfer unit 14 includes a lower outer wall portion 33 (see FIGS. 6D and 6F) (the fourth positioning portion). The lower outer wall portion 33 is a part of the unit right wall 14R. As illustrated in FIG. 6D, the lower outer wall portion 33 is arranged below the first unit securing portion 31 and left side with respect to the first unit securing portion 31. The lower outer wall portion 33 includes a lower protrusion 331. The lower protrusion 331 is a protrusion protruded from the right-side surface of the lower outer wall portion 33 rightward. The lower protrusion 331 is arranged extending in the front-rear direction.

As illustrated in FIG. 6F, mounting the intermediate transfer unit 14 to the imaging frame 10F brings the lower protrusion 331 of the lower outer wall portion 33 into abutment with the opposed surface 341 of the frame right inner wall portion 34. Consequently, when the above-described protrusion right surface portion 32R of the first frame securing portion 32 is brought into abutment with the bent rib 310, the position of the intermediate transfer unit 14 in the right direction is regulated. When the lower protrusion 331 is brought into abutment with the opposed surface 341, the position of the intermediate transfer unit 14 in the left direction is regulated. That is, in this embodiment, the bent rib 310, the first frame securing portion 32, the lower outer wall portion 33, and the frame right inner wall portion 34 function as the fourth positioning portions. This ensures the further accurate positioning between the primary transfer rollers 24 inside the intermediate transfer unit 14 and the photoreceptor drums 20 without via the components inside the apparatus main body 11. Especially, since the fourth positioning portions regulate the axial positions of the primary transfer rollers 24 and the photoreceptor drums 20, the relative positional relationship of the image formation regions of the primary transfer roller 24 and the photoreceptor drum 20 is easily and preferably adjusted.

While the above has described the image forming apparatus 1 according to one embodiment of the disclosure in detail, the disclosure is not limited to this. The disclosure can employ, for example, the following modified embodiments.

(1) While the above-described embodiment describes the aspect where the plurality of developing devices 23, the plurality of photoreceptor drums 20, and the intermediate transfer unit 14 are mounted to the imaging frame 10F in the identical direction, the disclosure is not limited to this. With another modified embodiment, the developing devices 23 and the photoreceptor drums 20 may be mounted to the imaging frame 10F along the lateral direction. When the intermediate transfer unit 14 is mounted to the imaging frame 10F from upward, compared with a unit including the developing devices 23 and the photoreceptor drums 20, the intermediate transfer unit 14 can be easily and reliably positioned with respect to the imaging frame 10F using the own weight of the intermediate transfer unit 14 with large weight.

(2) While the above-described embodiment describes the aspect where the second positioning portions position the intermediate transfer unit 14 in the vertical direction as the third direction, the disclosure is not limited to this. In another modified embodiment, the third direction of the intermediate transfer unit 14 may be a direction approximately perpendicular to the first direction (the lateral direction) and the second direction (the front-rear direction), and the second positioning portions may decide positioning of the intermediate transfer unit 14 in the third direction that inclines by a predetermined angle with respect to the vertical direction.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an apparatus main body;

a plurality of photoreceptor drums each rotatably driven around shaft centers extending in a first direction, the photoreceptor drums forming electrostatic latent images on circumference surfaces, the photoreceptor drums being arranged in a second direction with intervals, the second direction being perpendicular to the first direction;

a plurality of developing devices opposed to the plurality of respective photoreceptor drums, the developing devices supplying toner to the circumference surfaces on the photoreceptor drums to form toner images on the circumference surfaces;

a frame that supports the plurality of photoreceptor drums and the plurality of developing devices, the frame being removably attachable to the apparatus main body along the second direction, the frame being positioned to and secured to the apparatus main body;

an intermediate transfer unit mounted to the frame to be removably attachable to the apparatus main body integrated with the frame, the intermediate transfer unit including:

an intermediate transfer belt running to extend along the second direction, the intermediate transfer belt being opposed to the plurality of photoreceptor drums and circularly driven, the toner images being transferred from the plurality of photoreceptor drums to the intermediate transfer belt;

a first roller supporting the intermediate transfer belt at a distal end side in a mounting direction of the frame with respect to the apparatus main body;

a second roller supporting the intermediate transfer belt at a rear end side in the mounting direction; and a plurality of primary transfer rollers each opposed to the photoreceptor drums across the intermediate transfer belt at an inner peripheral portion of the intermediate transfer belt, the primary transfer rollers causing the toner images to be transferred from the photoreceptor drums to the intermediate transfer belt;

a secondary transfer roller arranged in the apparatus main body to be opposed to the first roller across the intermediate transfer belt, the secondary transfer roller forming a secondary transfer nip portion with the first roller where the toner images are transferred to a sheet;

first positioning portions arranged at the intermediate transfer unit and the frame, the first positioning portions positioning the intermediate transfer unit in the second direction inside the apparatus main body; and second positioning portions arranged at the intermediate transfer unit and the apparatus main body, the second positioning portions positioning a distal end side in the mounting direction of the intermediate transfer unit in a third direction inside the apparatus main body, the third direction intersecting with the first direction and the second direction.

2. The image forming apparatus according to claim 1, wherein the second positioning portions includes:

a cylinder portion arranged on a shaft center of the first roller in the intermediate transfer unit; and a fitted portion arranged in the apparatus main body, the cylinder portion being fittable to the fitted portion, and when the frame including the intermediate transfer unit is mounted to the apparatus main body, the cylinder portion fits the fitted portion to secure a position of the first roller in the third direction.

3. The image forming apparatus according to claim 2, wherein the second positioning portions further position the secondary transfer roller inside the apparatus main body.

4. The image forming apparatus according to claim 1, further comprising third positioning portions arranged at the intermediate transfer unit and the apparatus main body, the third positioning portions positioning a rear end side in the mounting direction of the intermediate transfer unit in the third direction inside the apparatus main body.

5. The image forming apparatus according to claim 4, wherein the intermediate transfer unit includes a plurality of biasing members, the biasing members biasing the plurality of respective primary transfer rollers toward the plurality of photoreceptor drums, the third positioning portions include:

a pair of abutting portions arranged on a rear end side in the mounting direction of the intermediate transfer unit with an interval in the first direction; and a pair of abutted portions opposed to the pair of respective abutting portions in the apparatus main body, wherein the abutting portions are brought into abutment with the abutted portions by a reactive force generated when the primary transfer rollers are brought into abutment with the photoreceptor drums by a biasing force from the biasing members, the abutment securing a position of the rear end side in the mounting direction of the intermediate transfer unit in the third direction.

6. The image forming apparatus according to claim 5, further comprising fourth positioning portions arranged at the intermediate transfer unit and the frame, the fourth positioning portions positioning the intermediate transfer unit in the first direction inside the apparatus main body.

7. The image forming apparatus according to claim 1, wherein the frame has an opening at a top surface portion, and the plurality of photoreceptor drums and the plurality of developing devices are mounted inside the frame via the opening, and subsequently mounting the intermediate transfer unit to the frame to cover the opening causes the intermediate transfer unit integrated with the frame to be attachable and removable to/from the apparatus main body.

* * * * *